United States Patent [19]

Abuyama

[11] Patent Number: 4,540,274

[45] Date of Patent: Sep. 10, 1985

[54] IMAGE FORMING APPARATUS

[75] Inventor: Yasuo Abuyama, Ebina, Japan

[73] Assignee: Toshiba Corporation, Kawasaki, Japan

[21] Appl. No.: 583,485

[22] Filed: Feb. 28, 1984

Related U.S. Application Data

[63] Continuation of Ser. No. 457,279, Jan. 11, 1983.

[30] Foreign Application Priority Data

Jan. 18, 1982 [JP] Japan ..... 57-5795

[51] Int. Cl.[3] ..... G03G 15/20

[52] U.S. Cl. ..... 355/14 FU; 355/3 FU; 355/14 C; 219/216

[58] Field of Search ..... 355/14 FU, 14 R, 3 R, 355/13, 15, 3 FU, 14 C, 3 SH; 118/652; 219/216; 361/106, 165

[56] References Cited

U.S. PATENT DOCUMENTS

| | | | |
|---|---|---|---|
| 3,649,262 | 3/1972 | Cade et al. | 118/652 |
| 3,960,446 | 6/1976 | Ogawa et al. | 355/13 |
| 3,989,370 | 11/1976 | Mooney | 355/14 FU |
| 4,104,692 | 8/1978 | Sudo et al. | 355/14 FU X |
| 4,161,644 | 7/1979 | Yanagawa et al. | 219/216 |
| 4,162,847 | 7/1979 | Brandon | 355/14 FU |
| 4,318,612 | 3/1982 | Brannan et al. | 355/14 FU |
| 4,324,486 | 4/1982 | Nishikawa | 355/14 FU |
| 4,348,102 | 9/1982 | Sessink | 355/14 SH |
| 4,349,269 | 9/1982 | Okada | 355/14 SH |
| 4,373,802 | 2/1983 | Yuge et al. | 355/14 FU |
| 4,391,509 | 7/1983 | Cavagnaro | 355/14 FU |
| 4,435,677 | 3/1984 | Thomas | 355/14 FU X |

FOREIGN PATENT DOCUMENTS

| | | |
|---|---|---|
| 0001475 | 4/1979 | European Pat. Off. . |
| 0070740 | 1/1983 | European Pat. Off. . |
| 83100008.8 | 3/1984 | European Pat. Off. . |
| 1572326 | 4/1966 | Fed. Rep. of Germany . |
| 2052392A | 1/1981 | United Kingdom . |

*Primary Examiner*—A. C. Prescott

*Attorney, Agent, or Firm*—Cushman, Darby & Cushman

[57] ABSTRACT

The invention provides an image forming apparatus having a control device to control a fixer and a paper conveyor system to perform preheating of the fixer and driving of the conveyor system for a predetermined time interval immediately after power is supplied, to stop the fixer and the conveyor system when preheating of the fixer is completed before the predetermined time interval has elapsed, and to continue operation of the conveyor system when a paper sheet is jammed in the paper conveyor system, even if preheating of the fixing means is completed before the predetermined time interval has elapsed.

6 Claims, 52 Drawing Figures

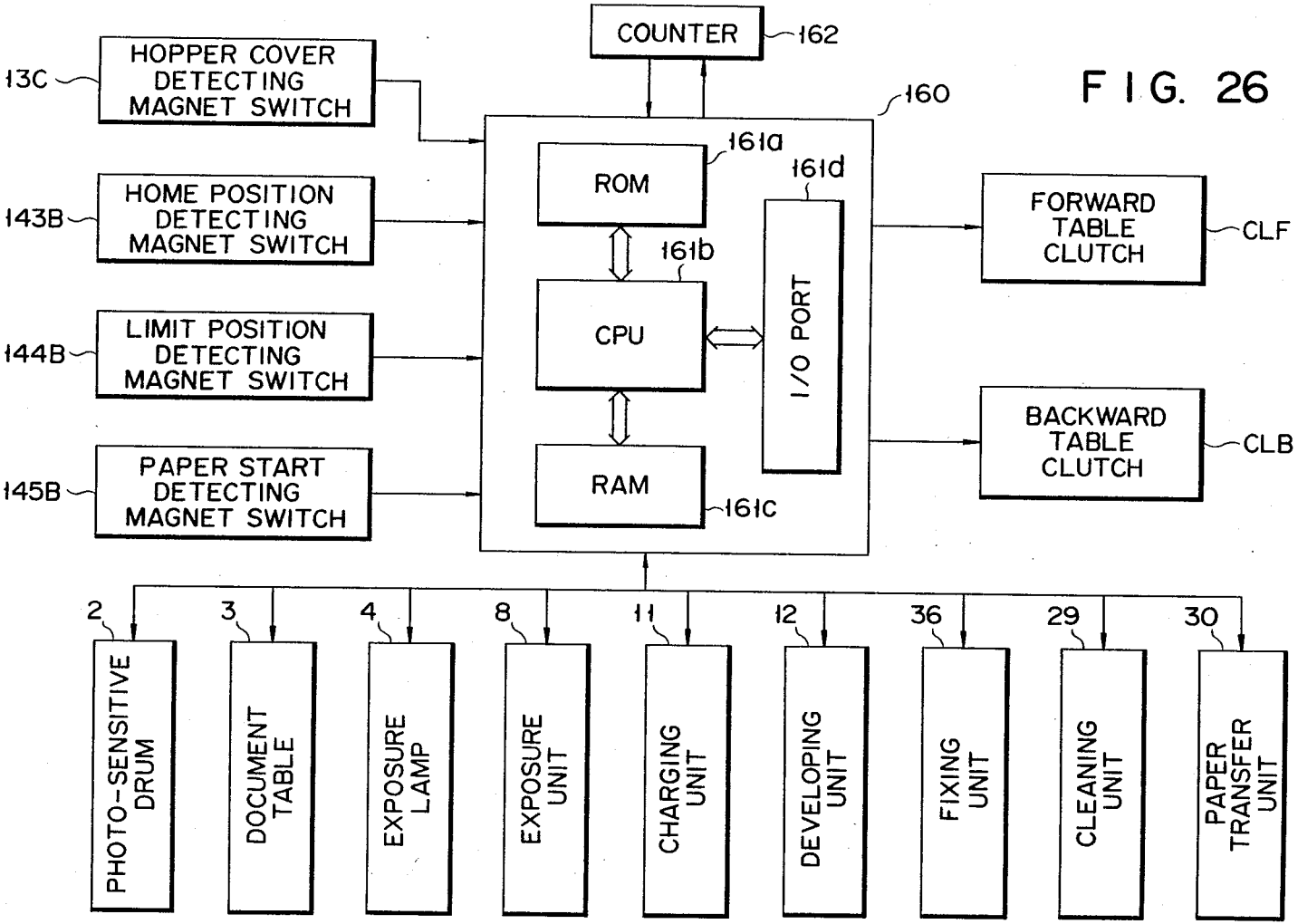
FIG. 26
COUNTER
162
160
ROM
161a
CPU
161b
I/O PORT
161d
RAM
161c
FORWARD TABLE CLUTCH
CLF
BACKWARD TABLE CLUTCH
CLB
HOPPER COVER DETECTING MAGNET SWITCH
13C
HOME POSITION DETECTING MAGNET SWITCH
143B
LIMIT POSITION DETECTING MAGNET SWITCH
144B
PAPER START DETECTING MAGNET SWITCH
145B
PHOTO-SENSITIVE DRUM
2
DOCUMENT TABLE
3
EXPOSURE LAMP
4
EXPOSURE UNIT
8
CHARGING UNIT
11
DEVELOPING UNIT
12
FIXING UNIT
36
CLEANING UNIT
29
PAPER TRANSFER UNIT
30

IMAGE FORMING APPARATUS

This is a continuation of application Ser. No. 457,279, filed Jan. 11, 1983.

BACKGROUND OF THE INVENTION

The present invention relates to an image forming apparatus having a drive system for allowing preheating of a fixer for a predetermined time interval and driving of a paper feeder system immediately after power is supplied.

In a conventional image forming apparatus such as an electronic copying machine, the drive system such as a main motor is operated for a predetermined time interval immediately after power is supplied, so that preheating of the fixer and driving of the paper feeder system can be performed. The predetermined time interval is determined by giving consideration to the time interval required for preheating the fixer.

The drive time interval is thus fixed independently of operational conditions. If the temperature of the fixer is already high enough to be ready for the next copying operation (e.g., immediately after the previous copying operation is completed), the fixer reaches a proper preheated temperature immediately after power is supplied. However, as described above, the drive time interval is fixed, and the fixer is continuously heated, thus resulting in time-consuming operation. Furthermore, when the fixer is repeatedly overheated, it may deteriorate. In addition, if a paper sheet is jammed when power is supplied, the operation of the drive system is stopped when the predetermined time interval for preheating the fixer has elapsed. As a result, the jammed paper sheet may not be removed but remains inside the copying machine. The operator must remove it if he wishes to perform copying.

SUMMARY OF THE INVENTION

The present invention has been made in consideration of the above situation, and has for its object to provide an image forming apparatus which allows a reduction in waiting time from power ON time to the copying ready mode, and elimination of the need for removal of a jammed paper sheet, thereby improving operability.

In order to achieve the above object of the present invention, there is provided an image forming apparatus, comprising: a photosensitive drum; an optical system for radiating light onto a document and grinding light reflected by the document to said photosensitive drum; discharger means for discharging a surface of said photosensitive drum; charging means for charging the surface of said photosensitive drum after said photosensitive drum is discharged; exposure means for exposing the surface of said photosensitive drum after said photosensitive drum is charged; developing means for visualizing an electrostatic latent image formed by said exposure means on the surface of said photosensitive drum; transferring means for transferring a visual image formed on the surface of said photosensitive drum onto a paper sheet; separating means for separating the paper sheet, onto which the visual image has been transferred, from said photosensitive drum; cleaning means for cleaning said photosensitive drum; fixing means for fixing the visual image transferred onto the paper sheet; conveyor means for conveying the paper sheet separated from said photosensitive drum; and controlling means for controlling said fixing means and said conveyor means to perform preheating of said fixing means and driving of said conveyor means for a predetermined time interval immediately after power is supplied, to stop said fixing means and said conveyor means when preheating of said fixing means is completed before the predetermined time interval has elapsed, and to continue operation of said fixing means and said conveyor means when a paper sheet is jammed in said paper conveyor means, even if preheating of fixing means is completed before the predetermined time interval has elapsed.

According to the image forming apparatus of the present invention, when preheating of the fixer is completed within the predetermined time interval, the copying ready mode is initiated, thus reducing the waiting time. Furthermore, when the paper sheet is jammed in the conveyor means even after preheating of the fixer is completed, the drive system is continuously operated until the paper sheet is removed, thus improving operability.

BRIEF DESCRIPTION OF THE DRAWINGS

Other objects and features of the present invention will be apparent from the following description taken in connection with the accompanying drawings, in which:

FIG. 26 is a block diagram of a main control section;

FIGS. 29A to 33F are flow charts for explaining the overall mode of operation of the paper feeder apparatus according to the present invention, in which FIGS. 29A and 29B are flow charts for explaining the standby operation of peripheral units around the paper feeder mechanism, FIGS. 33A to 33F are flow charts for explaining the copying operation using manual paper feed.

DETAILED DESCRIPTION OF THE PREFERRED EMBODIMENT

Figure 1:
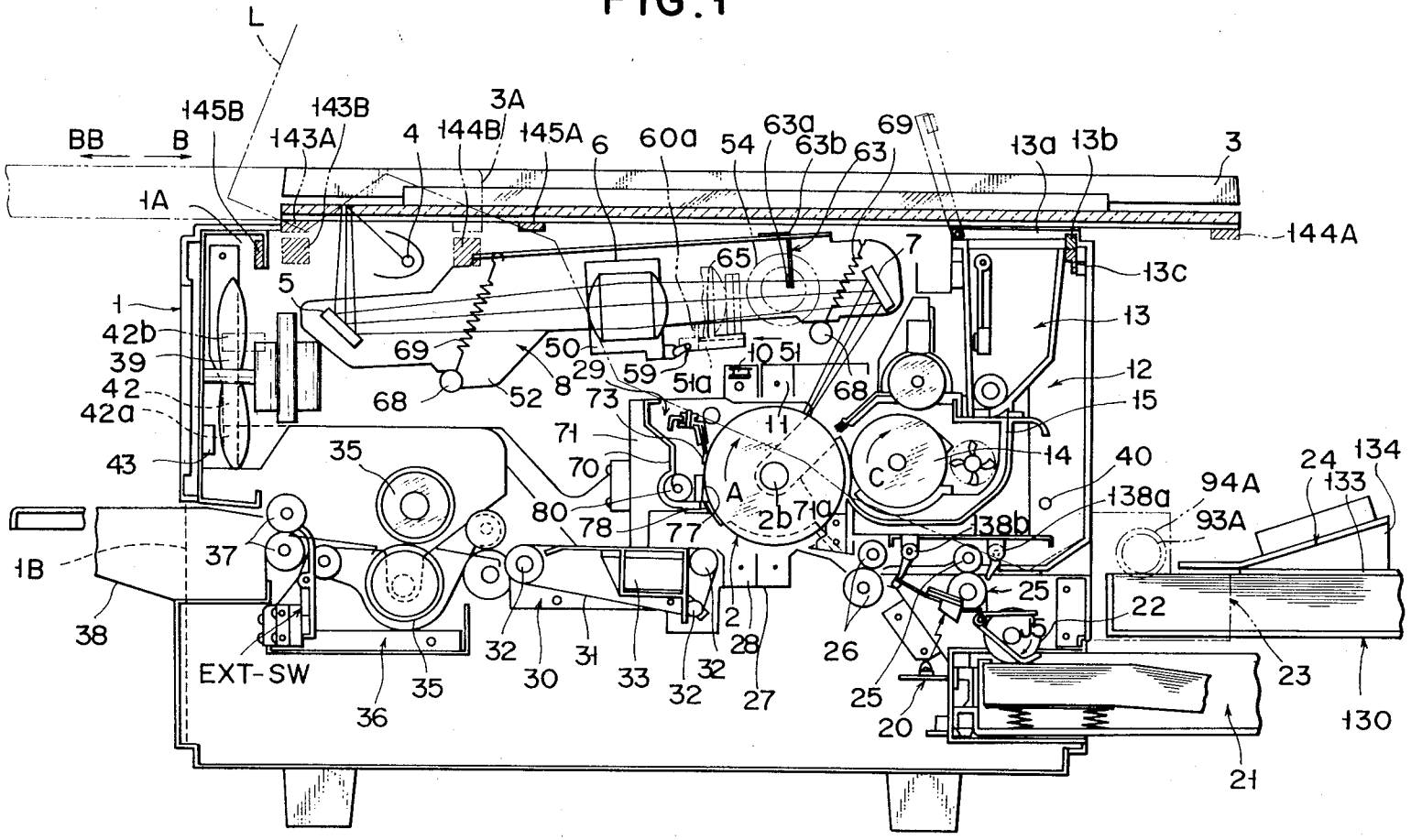
FIG. 1 is a schematic front sectional view of an image forming apparatus such as a copying machine having a paper feeder apparatus according to an embodiment of the present invention.

FIG. 1 is a schematic front sectional view of an image forming apparatus such as a copying machine having a display control device according to an embodiment of the present invention. Referring to FIG. 1, reference numeral 1 denotes a housing of the copying machine. A photosensitive drum 2 which has a celenium photosensitive film thereon and which is rotated in the direction indicated by arrow A in FIG. 1 is disposed substantially at the center of the housing 1. A document table 3 is disposed at the upper portion of the housing 1 and can reciprocate in the directions indicated by arrows B and BB. A document is placed on the document table 3 for execution of the copying operation. An exposure unit 8 is disposed below the document table 3 and includes an exposure lamp 4, a first mirror 5, a lens unit 6, and a second mirror 7. The exposure lamp 4 is arranged to radiate light onto the document placed on the document table 3. When the document table 3 reciprocates, the exposure lamp 4 illuminates the document from its leading edge to its trailing edge. Reflected light from the document is incident on the surface of the photosensitive drum 2 through the first mirror 5, the lens unit 6, and the second mirror 7.

In the vicinity of the photosensitive drum 2 are disposed, along the direction of rotation of the photosensitive drum 2 indicated by arrow A, a discharger 10 which discharges the surface charge of the photosensitive drum 2 and a charger 11 for charging the surface of the photosensitive drum 2. An electrostatic latent image is formed by the exposure unit 8 on the surface of the photosensitive drum 2 after it has been discharged. A developing unit 12 is disposed in front of the charger 11 to change the electrostatic latent image into a visible image by means of a developer (to be referred to as a toner hereinafter). The developing unit 12 has a toner hopper 13 for containing the toner, and a magnetic-brush developer 15 which allows a magnetic roller 14 rotating in the direction indicated by arrow C to bring the toner supplied from the toner hopper 13 into contact with the surface of the photosensitive drum 2. The developing unit 12 is detachably mounted in the housing 1. It is noted that a hopper cover 13*a* for opening/-closing the toner hopper 13 is disposed at the upper opening of the toner hopper 13. A magnet 13*b* for detecting the open/closed state of the toner hopper 13, and a hopper cover detecting magnet switch 13*c* are arranged in the toner hopper 13. A paper feeder apparatus 20 is disposed in front of the developing unit 12 to feed a paper sheet up to a position below the photosensitive drum 2. The paper feeder apparatus 20 has a paper cassette 21 which is detachably mounted at the side portion of the housing 1 and which contains a plurality of paper sheets, and a third paper feed roller 22 which feeds each paper sheet from the paper cassette 21. The paper feeder apparatus 20 further has a paper cassette 23 for use with a manual paper feed function and a pair of second paper feed rollers 25. The paper cassette 23 is also detachably mounted at a side portion of the housing 1 through a paper feed mechanism 24 which allows the paper cassette 23 to provide both manual and automatic paper feed. A paper sheet is fed from the paper cassette 23 to the second paper feed rollers 25. The paper feeding apparatus 20 also has a pair of aligning rollers 26 for aligning the leading edge of the paper sheet fed from either one of the paper cassettes 21 and 23. In front of the paper feeder apparatus 20 is arranged an assembly which is detachably mounted in the housing 1. The assembly comprises a transfer charger 27 for transferring the visible image formed on the surface of the photosensitive drum 2 onto the paper sheet conveyed by the aligning rollers 26, and a separating charger 28 for separating the paper sheet having the visible or toner image thereon from the photosensitive drum 2. It is noted that since the photosensitive drum 2 has an outer diameter of about 80 mm, a conventionally used separator need not be used to separate the paper sheet from the photosensitive drum 2. A cleaning unit 29 is disposed in front of the separating charger 28 to recover the toner left on the photosensitive drum 2. The discharger 10 is mounted on the cleaning unit 29 along the longitudinal direction of part of the outer surface of the photosensitive drum 2, and is spaced apart by a predetermined distance therefrom.

A suction/convey unit 30 is disposed near the photosensitive drum 2 to convey the paper sheet separated therefrom. In the suction/convey unit 30, a plurality of flat belts 31 each having a plurality of holes are looped around guide rollers 32 and are rotatable therearound. A suction duct 33 connected to a suction blower (not shown) is then disposed to be in contact with part of the inner surface of the flat belts. Thus, the paper sheet is attracted onto the surface of the flat belts 31 and is conveyed thereon. When the suction/convey unit 30 of the type described above is used, various sizes of paper sheet can be conveyed using a very simple construction. Furthermore, the suction duct 33 is disposed to improve cooling efficiency and vent efficiency of the housing 1.

A fixing unit 36 which comprises heat rollers 35 and the like is disposed to fix the visible image transferred onto the paper sheet conveyed from the suction/convey unit 30. The fixed paper sheet is then discharged to the external tray 38 through discharge rollers 37. Referring to FIG. 1, reference numeral 39 denotes an exhaust fan.

The exposure unit 8, the developing unit 12, the transfer charger 27, the separating charger 28, the cleaning unit 29 and the suction/convey unit 30 are integrally formed into an assembly which is detachably mounted in the housing 1, thus resulting in low cost and easy maintenance.

Figure 2:
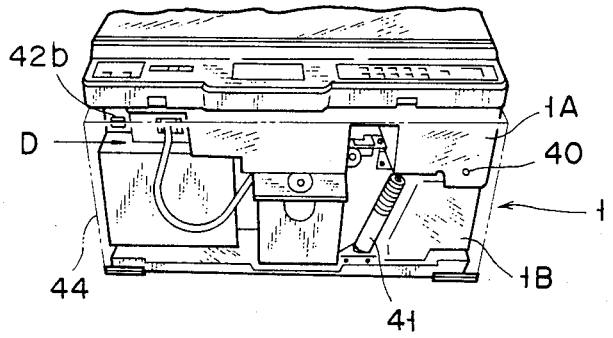
FIG. 2 is a schematic view of the copying machine shown in FIG. 1.

The mechanism for opening/closing the housing 1 will be described with reference to FIG. 2. FIG. 2 is a schematic view of the copying machine shown in FIG. 1. The housing 1 is divided into an upper housing unit 1A and a lower housing unit 1B. The upper and lower housing units 1A and 1B are pivotal about a shaft 40 which connects one end of each of the upper and lower housing units 1A and 1B. The other end of the upper housing unit 1A may be separated from the other end of the lower housing unit 1B so as to form a desired angle (e.g., 30° ) therebetween. Since the upper housing unit 1A includes the photosensitive drum 2, the document table 3, the exposure unit 8, the developing unit 12, the cleaning unit 29, the upper one of the second paper feed rollers 25, and the upper one of the aligning rollers 26, the upper and lower housing units 1A and 1B are separated by pivotal movement about the shaft 40 along the paper convey path indicated by the alternate long and two dashes line L in FIG. 1. Therefore, a jammed paper sheet can be easily removed. Furthermore, units such as the cleaning unit 29 and the photosensitive drum 2 can be easily removed for cleaning. A biasing member 41 is disposed at the intermediate portion which corresponds to each of the front and rear sides of the upper and lower housing units 1A and 1B. The upper and lower housing units 1A and 1B are pivotally separated by the biasing force of the biasing members 41 by a desired angle. As shown in FIG. 1, a lever 42 is pivotally disposed at the opening end of the upper housing unit 1A. A stopper 43 which stops a hook 42*a* disposed at the free end of the lever 42 is mounted on the lower housing unit 1B. A control rod 42*b* which is operated by the operator is mounted at an intermediate portion of the lever 42. As shown in FIG. 2, the operator can operate the control rod 42*b* from the outside of the upper housing unit 1A. A front cover 44 which can cover the control rod 42*b* is arranged so that it may be opened/-closed, and is pivotal about its lower end.

In the opening/closing mechanism of the type described above, in order to pivotally separate the upper and lower housing units 1A and 1B about the shaft 40 through a desired angle, the operator first opens the front cover 44 and pushes the control rod 42*b* in the direction indicated by arrow D in FIG. 2. Upon the above operation, the hook 42*a* is separated from the stopper 43. The upper and lower housing units 1A and 1B are urged to pivotally separate by the biasing force of the biasing member 41. Therefore, unless the front cover 44 is opened, the upper and lower housing units 1A and 1B cannot be pivotally separated. As a result, an accident caused by erroneous operation can be completely prevented.

Figure 3:
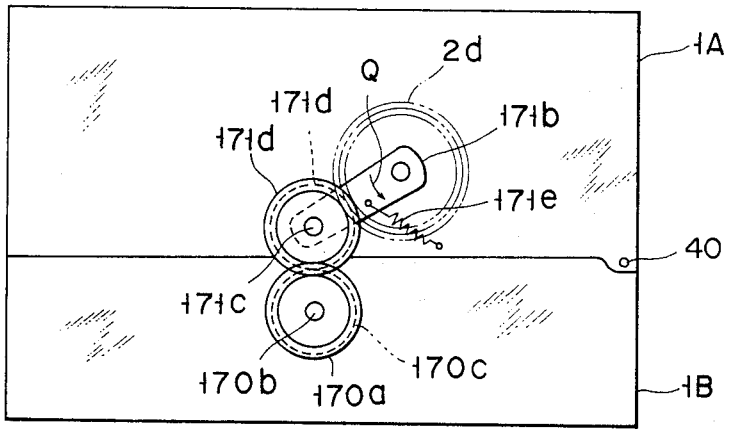
FIG. 3 is a front view showing an example of a gear mechanism.
Figure 4:
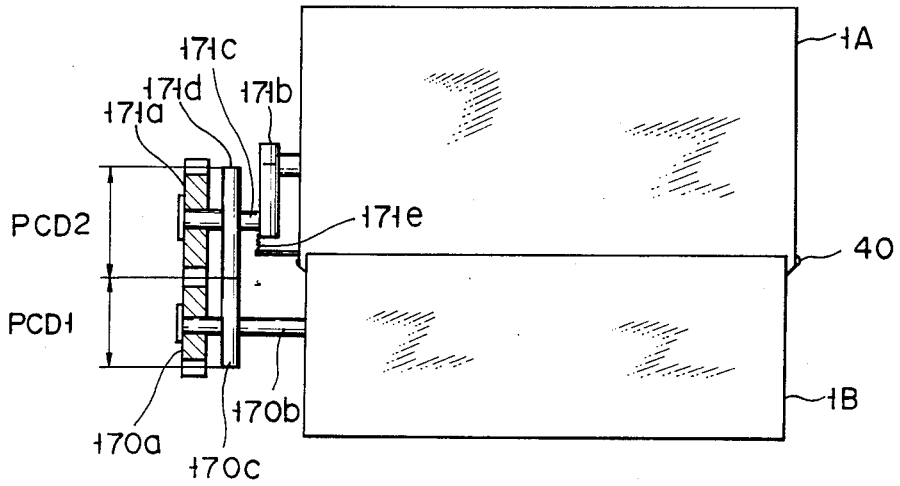
FIG. 4 is a side view of the gear mechanism shown in FIG. 3.

The gear mechanism respectively mounted in the upper and lower housing units 1A and 1B will be described with reference to FIGS. 3 and 4. FIG. 3 is a front view showing an example of the gear mechanism, and FIG. 4 is a side view thereof. The gear mechanism shown in FIGS. 3 and 4 is of a type which may be applied to a system for driving a drive gear 2*d* of the photosensitive drum 2. Reference numeral 170*a* denotes a drive gear which receives the rotational force from a driving source (not shown). The drive gear 170*a* is mounted in the lower housing unit 1B through a drive shaft 170*b*. A first guide roller 170*c* is coaxial with the drive gear 170*a*. The first guide roller 170*c* has an outer diameter which is the same as that of a pitch circle diameter (to be referred to as a PCD1 hereinafter) of the drive gear 170*a*. Referring to FIG. 3, reference numeral 171*a* denotes an idler gear which meshes with the drive gear 170*a*. The idler gear 171*a* is mounted on a stationary shaft 171*c* which is in turn mounted on the free end of a swing lever 171*b*. The swing lever 171*b* is swingable with respect to the upper housing unit 1A, whereas the idler gear 171*a* is rotatable about the stationary shaft 171*c*. A second guide roller 171*d* is mounted on the stationary shaft 171*c* to be coaxial with the idler gear 171*a*, and can engage with the outer surface of the first guide roller 170*c*. The second guide roller 171*d* has an outer diameter which is the same as the pitch circle diameter (to be referred to as a PCD2 hereinafter) of the idler gear 171*a*. The swing lever 171*b* is biased by a biasing member 171*e* in the direction indicated by arrow Q in FIG. 3.

In the gear mechanism of the type described above, when the upper housing unit 1A is pivoted about the shaft 40 so as to close the upper housing unit 1A through the hook 42*a* of the lever 42 and the stopper 43 (FIG. 1), the outer surface of the first guide roller 170*c* abuts against the outer surface of the second guide roller 171*d* by the biasing force of the biasing member 171*e*. Therefore, the drive gear 170*a* properly meshes with the idler gear 171*a* along the pitch circle.

A meshing error between the gears which are respectively mounted in the upper and lower housing units 1A and 1B pivoted about the shaft and which are meshed with each other when the upper and lower housing units 1A and 1B are closed can be cancelled by abutment between the guide rollers which have outer diameters respectively corresponding to PCD1 and PCD2. As a result, damage, wear and noise of the gears caused by meshing error can be eliminated.

Figure 5:
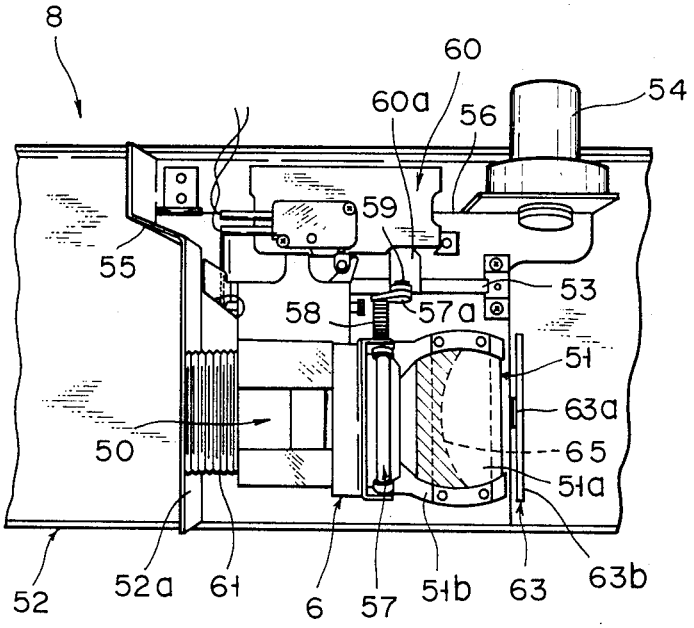
FIG. 5 is a schematic view showing the position of an exposure unit corresponding to an equal-size mode.
Figure 6:
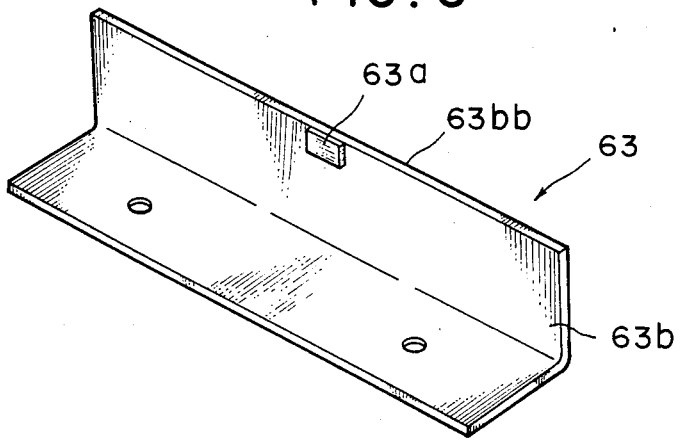
FIG. 6 is a perspective view of a light sensor.
Figure 7:
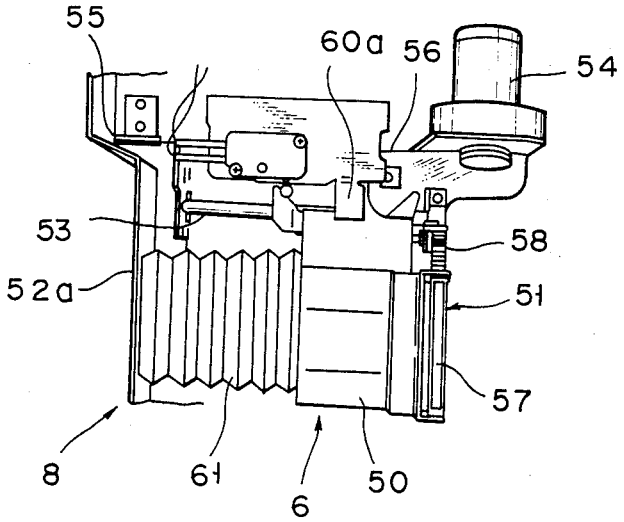
FIG. 7 is a schematic view showing the position of the exposure unit (FIG. 5) in the size-reduction mode.

The exposure unit 8 will be described in detail with reference to FIGS. 5 to 7. In the exposure unit 8, the lens unit 6 is moved along the optical path to provide the equal-size mode and the size-reduction mode. The lens unit 6 comprises a lens block 50 and an auxiliary lens assembly 51 which is pivotal thereabout. The lens block 50 is disposed to reciprocate along the optical path, while it is held and supported by a guide rod 53 mounted on a frame 52 of the exposure unit 8. The lens block 50 is coupled to an intermediate portion of a wire 56 looped between a lens motor 54 and a pulley 55 and is driven to reciprocate. In the auxiliary lens assembly 51, a frame 51*b* which has an auxiliary lens 51*a* thereon is integrally formed with a crankshaft 57. The integral body is rotatably mounted on the upper end of the lens block 50. A coil spring 58 is disposed around the crankshaft 57. One end of the coil spring 58 is connected to the lens block 50, whereas the other end thereof is connected to a crank 57*a* of the crankshaft 57. The auxiliary lens assembly 51 is biased downward in FIG. 5. A guide roller 59 is mounted at the end of the crank 57*a*. When the lens block 50 is located in the position shown in FIG. 5 (this position is called the equal-size mode position hereinafter), the guide roller 59 engages with an engaging portion 60*a* of a holder 60 to keep the auxiliary lens assembly 51 horizontal. A partition plate 52*a* is mounted at an intermediate portion of the frame 52. One end of a bellows 61 is mounted on the partition plate 52*a* to cover slits (not shown) formed in the partition plate 52*a*, and the other end thereof is mounted on one end of the lens block 50. When the bellows 61 of the type described above is mounted, air in the vicinity of the lens unit 6 flows through the slits. Therefore, the lens unit 6 may not be contaminated, and hermetic conditions between the document and the image at the boundary of the lens unit can be maintained. A photodetector 63 having a photosensor element 63*a* for automatic exposure is disposed along the optical path, thereby preventing irregular light scattering on the photosensitive drum 2. The photosensor element 63*a* is mounted on a holder 63*b* having a sufficient width to completely block the optical path. Furthermore, the photosensor element 63*a* does not extend above a distal end 63*bb* of the holder 63*b*. An angle adjustment plate 65 is mounted on the auxiliary lens 51*a* to adjust the amount of light in the size-reduction mode. When the lens unit 6 is located at the position shown in FIG. 7 and indicated by the alternate long and two dash line in FIG. 1 (this position is referred to as a size-reduction position hereinafter), the angle adjustment plate 65 is located so as to block the lower half of the optical path, so that light which is to be incident on the photodetector 63 is not blocked in the size-reduction position. It is noted that the frame adjustment plate 65 can be adopted to any copying machine which has a size-reduction function. It is also possible to mount a lens for size-reduction. When the photodetector for automatic exposure is disposed at the lower half of the optical path, the angle adjustment plate can be disposed at the upper half of the optical path.

The frame 52 for the exposure unit 8 is placed on two stays 68 mounted in the upper housing unit 1A to perform alignment. The frame 52 is brought into tight contact with the stays 68 through tension coil springs 69 which are detachably hooked thereto.

The equal-size mode and the size-reduction mode which are performed by the exposure unit 8 will be described hereinafter. When the equal-size mode is initiated, the lens unit 6 is set at the equal-size position indicated by the solid line in FIGS. 1 and 5 through the lens motor 54 and the wire 56. In this case, the auxiliary lens assembly 51 is kept substantially horizontal by the engaging portion 60*a* and the guide roller 59. However, when the size-reduction mode is initiated, the lens unit 6 is located in the size-reduction position indicated by the two dash line in FIGS. 1 and 7 through the lens motor 54 and the wire 56. In this case, the auxiliary lens assembly 51 is pivoted by the biasing force of the coil spring 58 to be located on the optical path since the guide roller 59 is separated from the engaging portion 60*a*.

Figure 8:
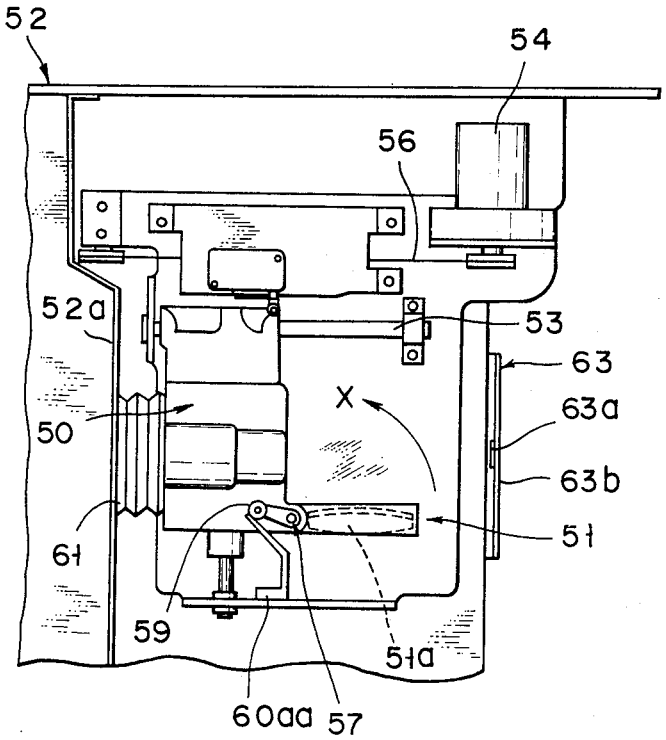
FIG. 8 is a bottom view showing the position of another exposure unit in the equal-size mode.
Figure 9:
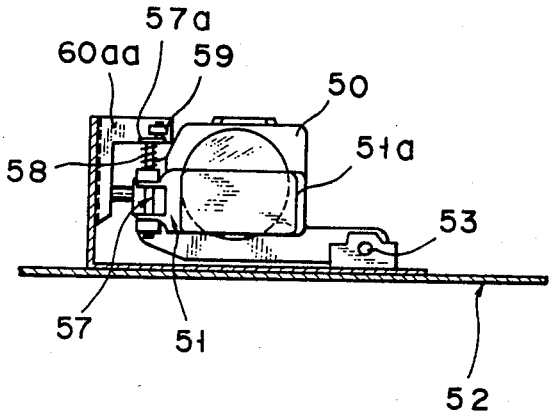
FIG. 9 is a partial side sectional view showing the position of the exposure unit (FIG. 8) in the size-reduction mode.

It is possible to use another exposure unit whose bottom and partial side sectional views are respectively shown in FIGS. 8 and 9, in place of the exposure unit of the type described above. The same reference numerals as used in FIGS. 5 to 7 denote the same parts in FIGS. 8 and 9, and a detailed description thereof will be omitted. The exposure unit shown in FIGS. 8 and 9 is substantially the same as that shown in FIGS. 5 to 7, except that an auxiliary lens assembly 51 shown in FIGS. 8 and 9 has a transverse open structure instead of the vertical open structure of the lens assembly of the exposure unit shown in FIGS. 5 to 7. Specifically, the auxiliary lens assembly 51 which is integral with the crankshaft 57 is mounted at a front portion of the lens block 50. One end of the coil spring 58 fitted around the crankshaft 57 is connected to the lens block 50, and the other end thereof is connected to the crank 57*a* of the crankshaft 57, so that the auxiliary lens assembly 51 is biased in the direction indicated by arrow X in FIG. 8. A guide 60*aa* is disposed to guide the guide roller 59 mounted at the end of the crank 57*a*. In the equal-size position shown in FIG. 8, the auxiliary lens assembly 51 is located outside the optical path. In the size reduction position shown in FIG. 9, the auxiliary lens assembly 51 is pivoted in the direction indicated by arrow X in FIG. 8 to block the optical path since the guide roller 59 is separated from the guide 60*aa*.

When the exposure unit is arranged in the manner described above, toner and dust will not remain on the auxiliary lens 51*a*. As a result, the image quality will not be degraded by contamination of the auxiliary lens 51*a*.

Figure 10:
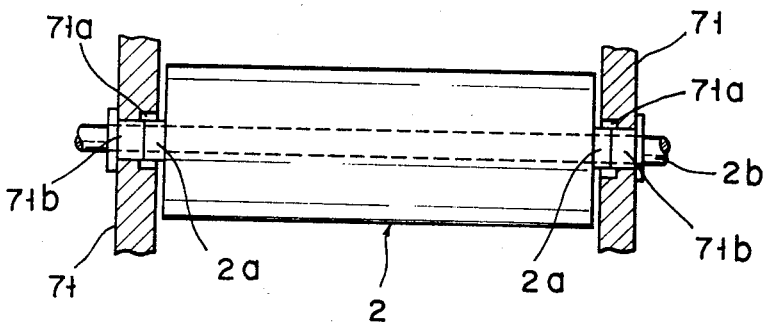
FIG. 10 is a representation showing the relationship between a side frame of a cleaning unit and a photosensitive drum.
Figure 11:
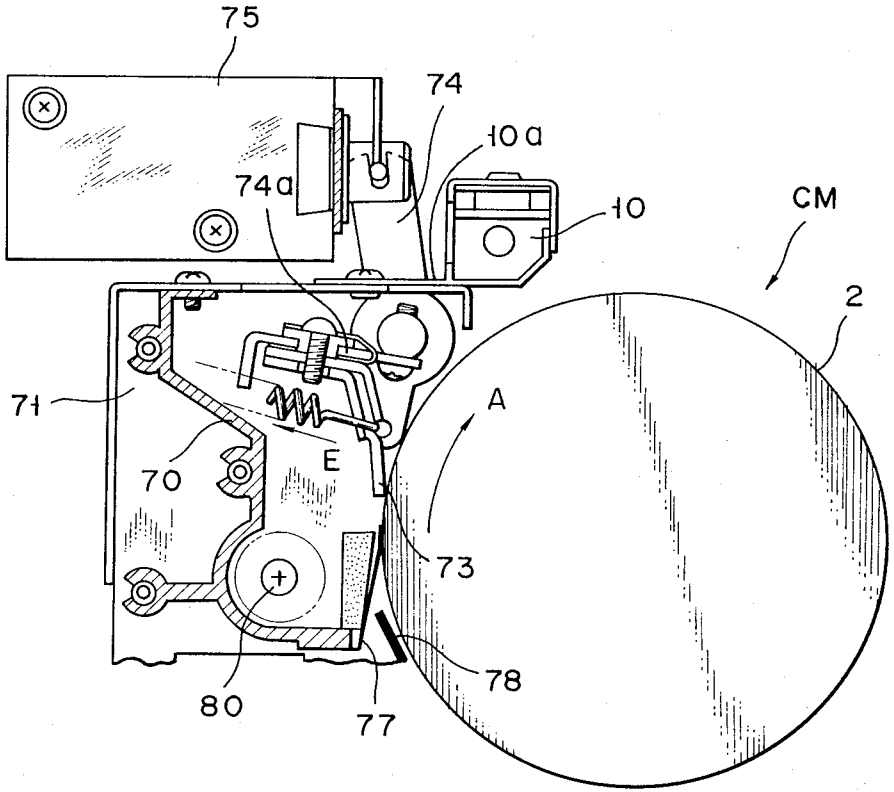
FIG. 11 is a schematic sectional view showing the cleaning unit and a cleaning mechanism.
Figure 12:
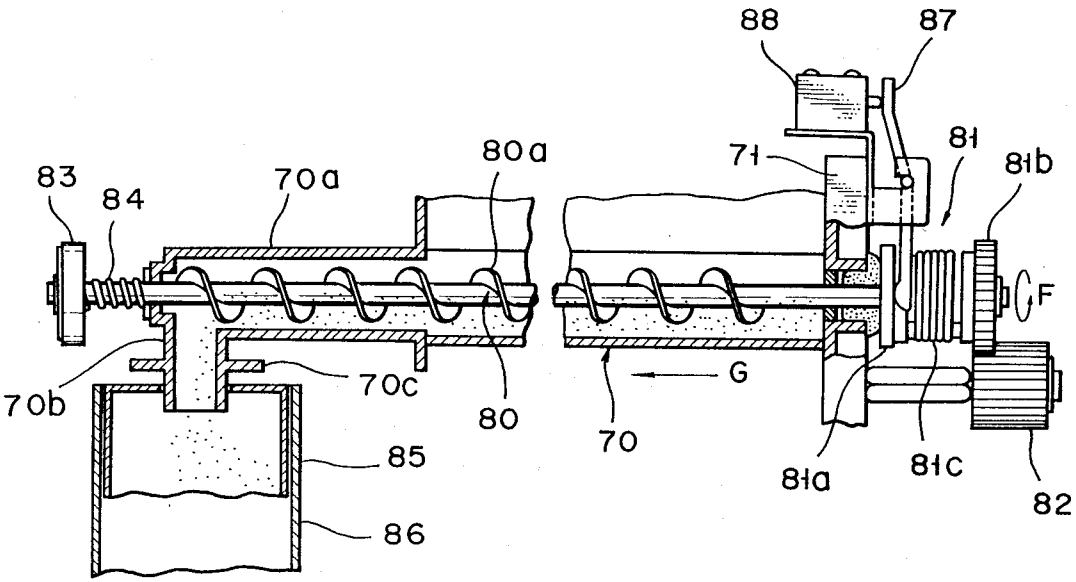
FIGS. 12 and 13 are detailed views showing part of the cleaning unit.
Figure 13:
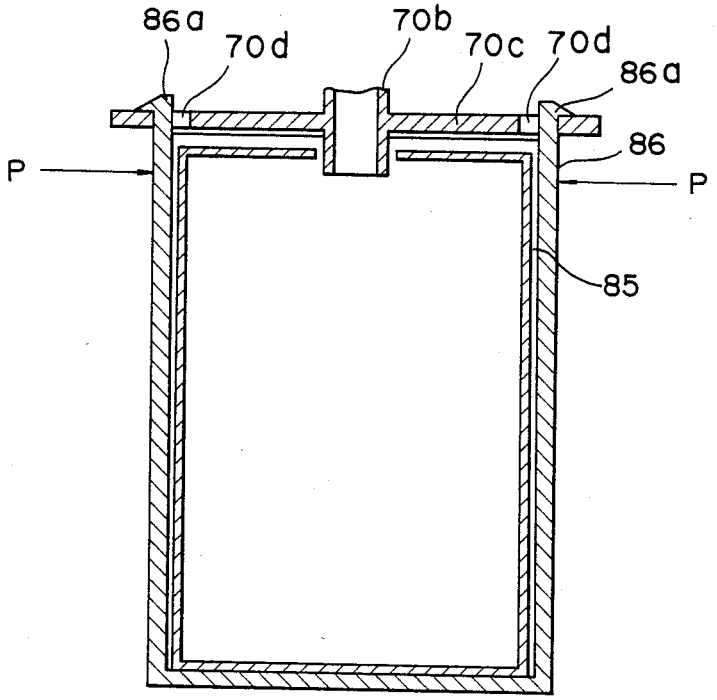

The cleaning unit 29 will be described in detail with reference to FIGS. 10 to 13. Side frames 71 are mounted at either side of the rear frame 70. As shown in FIG. 10 with reference to FIG. 1, the side frames 71 have inclined guide grooves 71*a* for guiding bosses 2*a* disposed at either side of the photosensitive drum 2, respectively. Bushes 71*b* which respectively engage with the bosses 2*a* are disposed at the terminal ends of the guide grooves 71*a*. When a photosensitive drum shaft 2*b* extends through a support (not shown), the bushes 71*b* and the photosensitive drum 2, the positions of the integral photosensitive drum 2 and the cleaning unit 29 are aligned. The above structure has an advantage in that fine adjustment of the relative positions between the photosensitive drum 2 and the cleaning unit 29 need not be performed, thus simplifying assembly and maintenance. A cleaning blade 73 is disposed in the rear frame 70 to be selectively and longitudinally brought into contact along part of the outer surface of the photosensitive drum 2. The cleaning blade 73 is mounted on a pivot lever 74 through a holder 74*a*. One end of the pivot lever 74 is biased in the direction indicated by arrow E in FIG. 11. The other end of the pivot lever 74 is connected to a solenoid 75. Furthermore, the pivot lever 74 is pivotal about the side frame 71. When the solenoid 75 is energized, the pivot lever 74 is pivoted against the biasing force. The cleaning blade 73 is then longitudinally brought into tight contact with part of the surface of the photosensitive drum 2. Therefore, when a power failure occurs, the solenoid 75 is deenergized and the cleaning blade 73 is separated from the photosensitive drum 2. The surface of the photosensitive drum will not be damaged by the cleaning blade 73. A blade 77 is disposed below the cleaning blade 73 to prevent the toner scraped from the photosensitive drum 2 from scattering to the outside. Since the blade 77 is constantly in contact with the photosensitive drum 2, the blade 77 comprises a urethane rubber sheet having a thickness of about 0.3 mm. The amount of deformation (distance between the outer surface of the photosensitive drum in normal condition and the distal end of the blade 77 when the blade 77 is not brought into contact with the photosensitive drum 2) falls within a range of 0.5 to 1.0 mm. A magnet 78 is disposed below the blade 77. The magnet 78 serves to recover the carrier attached to the surface of the photosensitive drum 2. When development is performed by the magnetic-brush developer 15, a small amount of carriers (e.g., iron powder) of the toner is attracted onto the photosensitive drum 2, and the carriers left between the cleaning blade 73 and the photosensitive drum 2 may damage the surface of the photosensitive drum 2. The blade 77 is disposed to prevent such a problem. An auger shaft 80 having a spiral auger 80*a* as shown in FIG. 12 is disposed at the bottom of the rear frame 70. The auger shaft 80 is rotatably supported by the rear frame 70 and the side frames 71. A spring clutch 81 is mounted on one end of the auger shaft 80 at the side of the side frame. The spring clutch 81 comprises a boss 81*a* mounted on the auger shaft 80, a drive gear 81*b* rotatable at a predetermined position of the auger shaft 80, and a clutch spring 81*c* movable between the drive gear 81*b* and the boss 81*a*. When the drive gear 81*b* is rotated in the direction indicated by arrow F in FIG. 12 through an idler gear 82, the rotational force is transmitted to the auger shaft 80. A knob 83 is mounted at the other end of the auger shaft 80. When the knob 83 is rotated in the direction indicated by arrow F in FIG. 12, the auger shaft 80 can be rotated independently of the drive gear 81*b* by means of the spring clutch 81. A coil spring 84 is mounted on that portion of the auger shaft 80 between the knob 83 and the rear frame 70, so that the auger shaft 80 is biased in the direction indicated by arrow G in FIG. 12. Pipes 70*a* and 70*b* are disposed at the rear frame end portion which is opposite to the side frame. The pipe 70*b* extends downward. A collar 70*c* is formed extending outward from the pipe 70*b*. A container 86 which contains a toner bag 85 for containing the toner recovered by the cleaning blade 73 is detachably supported by the collar 70*c*. A detachable mechanism of the container 86 is shown in FIG. 13. The container 86 is made of a flexible material to have a box shape with an upper opening. A pair of pawls such as hooks 86*a* extend from the two sides so as to align with the upper surface thereof. A pair of holes 70*d* are formed in the collar 70*c* and engage with the hooks 86, respectively, thereby supporting the container 86 by the collar 70*c*. When the operator applies an urging force p to the container 86 in the direction shown in FIG. 13, the container 86 is deformed and may be removed. An actuator 87 is rotatably disposed on the side frame 71. One end of the actuator 87 engages with the boss 81*a*, and the other end thereof engages with the detection end of a microswitch 88.

Since the cleaning unit 29 can be aligned together with the photosensitive drum 2, the discharger 10 mounted on the side frame 71 of the cleaning unit 29 through the holder 10*a* can be aligned solely with the cleaning blade 73 mounted on the side frame 71 of the cleaning unit 29 through the pivot lever 74 or the like, thus simplifying assembly and improving maintenance efficiency. A cleaning mechanism CM (FIG. 11) comprising the photosensitive drum 2 and the cleaning blade 73 is formed into an assembly through the rear and side frames 70 and 71 of the cleaning unit 29. When the operator opens the upper housing unit 1A by means of the control rod 42*b*, he can remove the photosensitive drum shaft 2*b* from the upper housing unit 1A or mount it thereinto. Even if a paper sheet is jammed between the photosensitive drum 2 and the cleaning blade 73 due to erroneous separating operation by the separating charger 28, the operator can remove the cleaning mechanism CM from the upper housing unit 1 to remove the jammed paper sheet. The photosensitive drum 2 may not be damaged, unlike the case in which the jammed paper sheet is forcibly removed.

Figure 14:
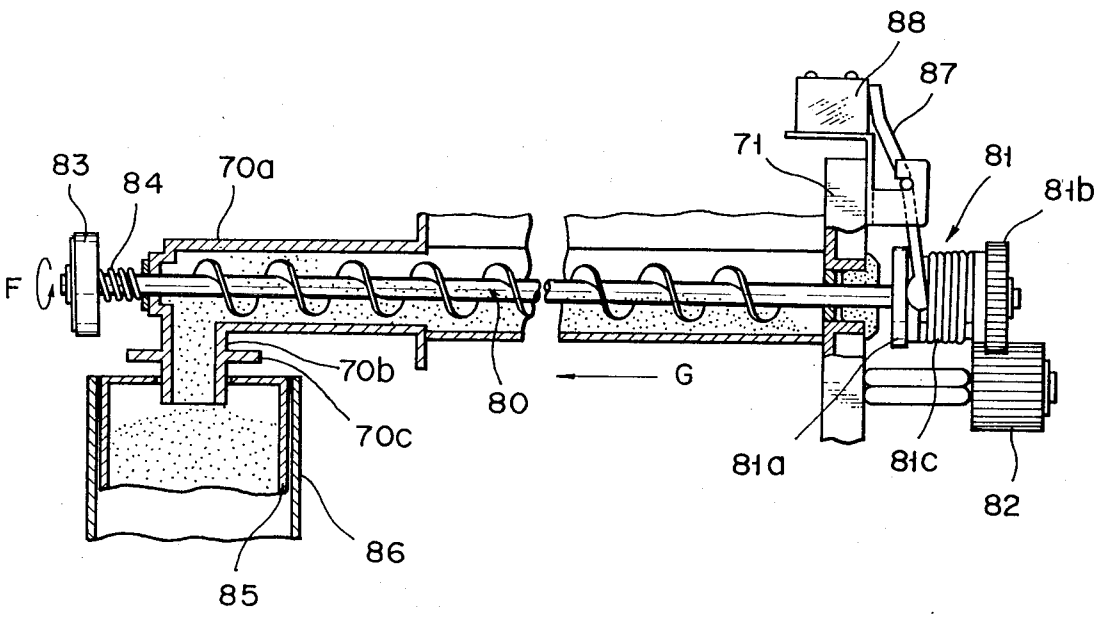
FIG. 14 is a view showing the mode of operation of part of the cleaning unit.

The mode of operation of the cleaning unit will be described with reference to FIG. 14. The toner scraped from the photosensitive drum 2 by the cleaning blade 73 falls onto the auger shaft 80 and is conveyed by the auger shaft 80 upon its rotation in the direction indicated by arrow F in FIG. 12 through the idler gear 82 and the spring clutch 81. The toner then passes through the pipes 70*a* and 70*b* and is stored in the toner bag 85. When the toner bag 85 is filled with the recovered toner, the toner becomes filled in the pipes 70*a* and 70*b* to disable rotation of the auger shaft 80 at a predetermined position. Therefore, the auger shaft 80 is rotated in the direction indicated by arrow G in FIG. 12 against the biasing force of the coil spring 84 and is kept in the condition shown in FIG. 14. Upon reverse rotation of the auger shaft 80, the end face of the boss 81*a* causes the actuator 87 to rotate, so that the microswitch 88 is turned on. When the microswitch 88 is ON, it is detected that the toner bag 85 is filled with the toner. A "toner full" signal from the microswitch 88 is supplied to a central control device 161 to be described in detail later, and a display unit 152 also to be described in detail later is driven to indicate the full state of the bag. The subsequent copying operation is cancelled. Thereafter, the operator removes the container 86 from the collar 70*c* and empties the recovered toner. In order to restore the auger shaft 80 to the condition shown in FIG. 12, the operator manually rotates the auger shaft 80 in the direction indicated by arrow F through the knob 83 to remove the toner filled in the pipes 70*a* and 70*b*. The auger shaft 80 is then biased by the coil spring 84 and is moved in the direction indicated by arrow G in FIG. 14. As a result, the auger shaft 80 is restored to the condition shown in FIG. 12.

The paper feeder apparatus 20 will now be described in detail with reference to FIGS. 15 to 23.

Figure 15:
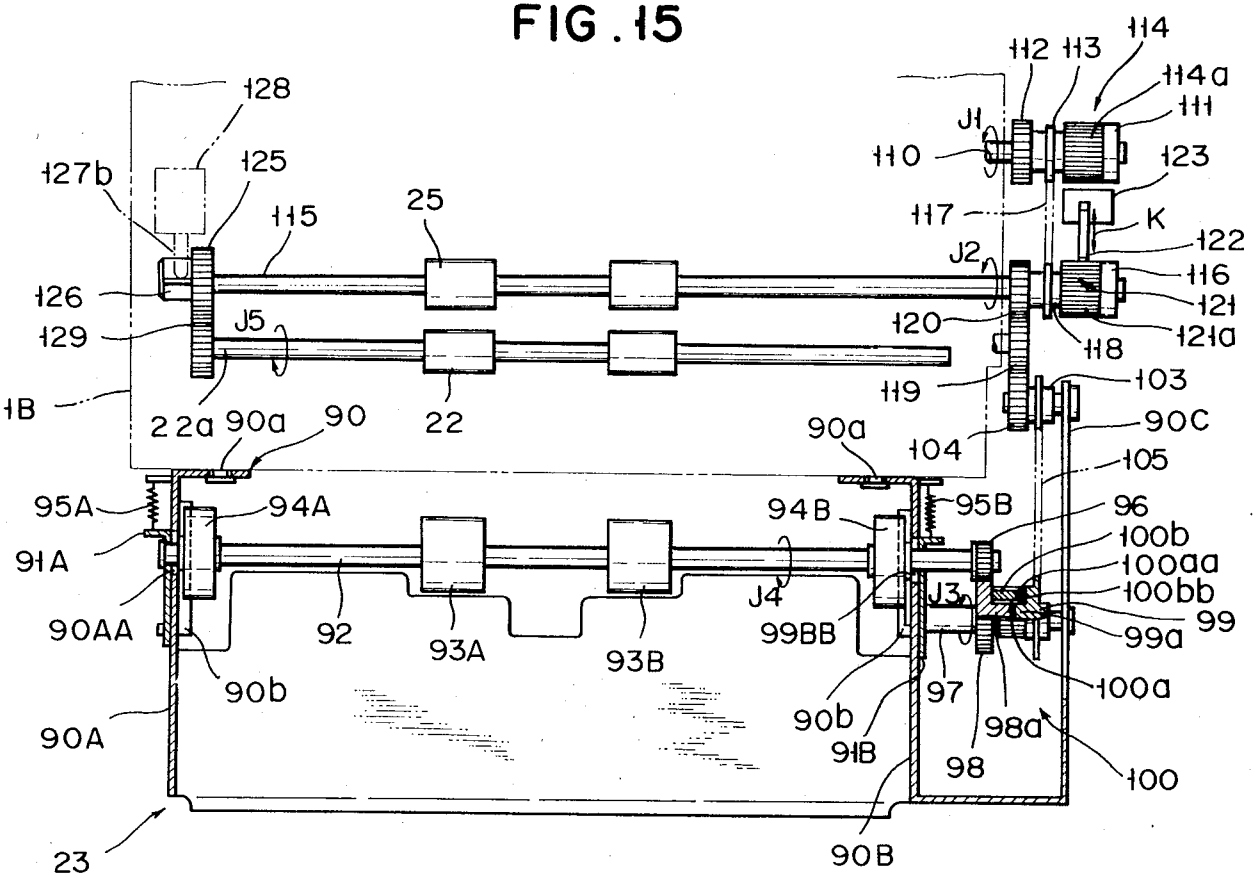
FIG. 15 is a schematic plan view of a paper feeder mechanism for a paper cassette with a manual feed function.
Figure 16:
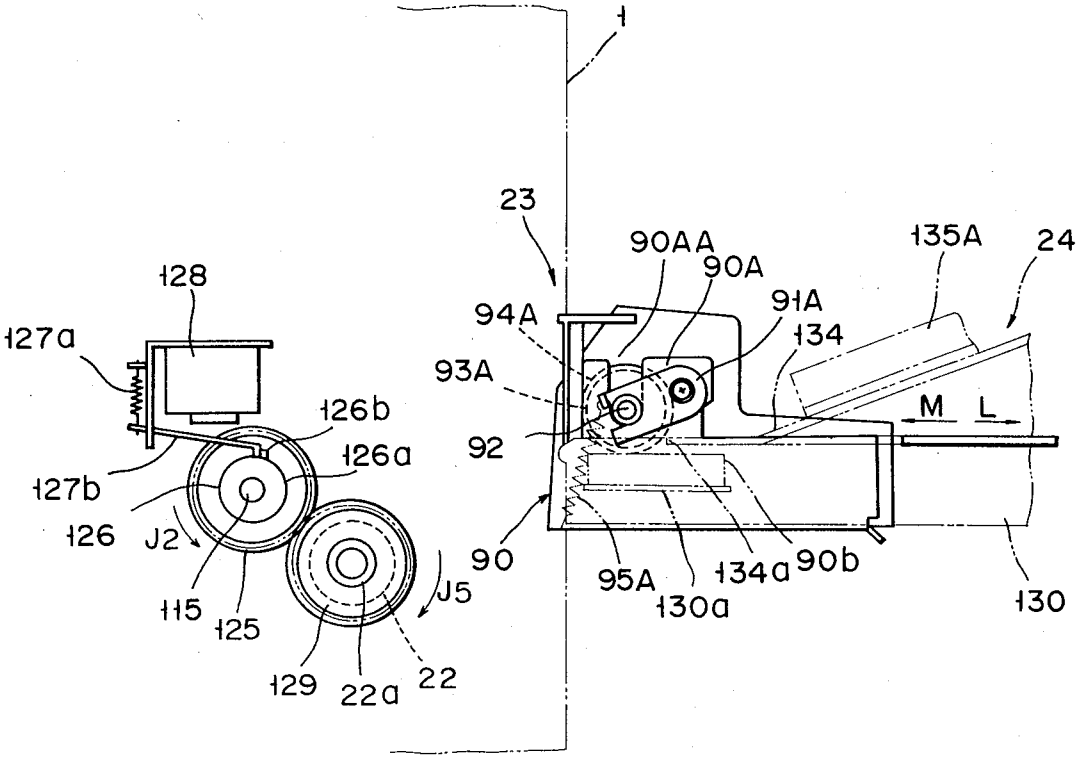
FIG. 16 is a schematic front view of the paper feeder mechanism shown in FIG. 15.
Figure 17:
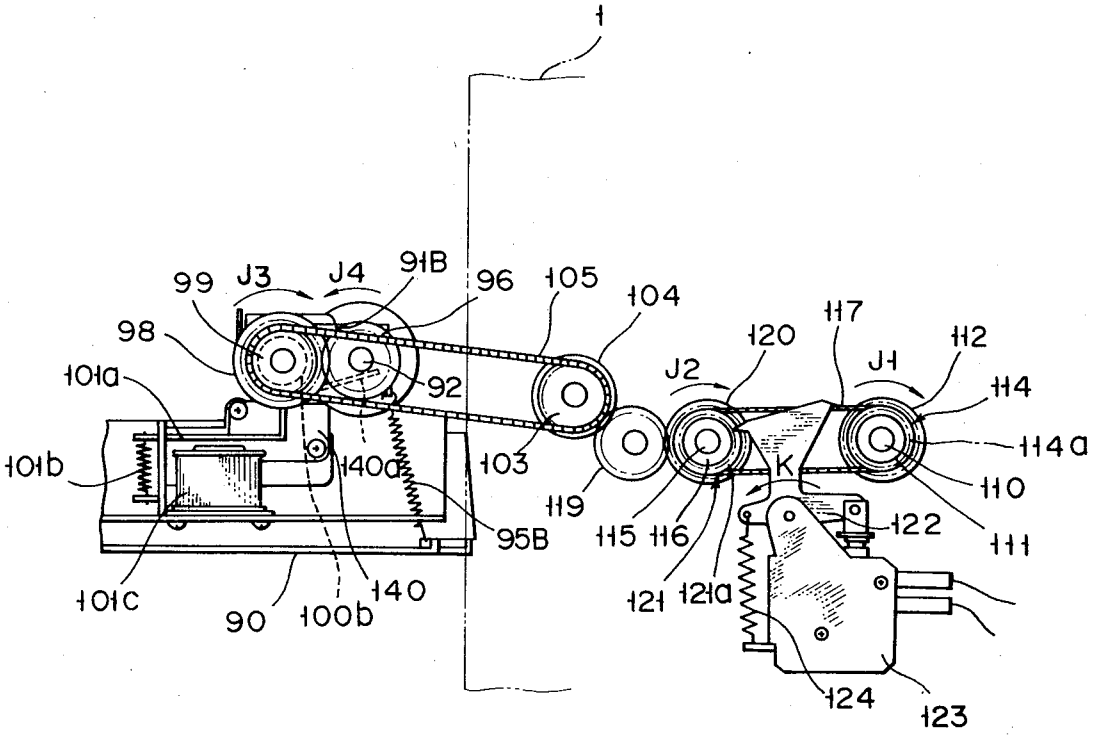
FIG. 17 is a schematic rear view of the paper feeder mechanism shown in FIG. 15.

The paper feeder mechanism 24 for paper cassette with a manual feed function is arranged in a manner as shown in FIGS. 15 to 17. FIG. 15 is a plan view of the paper feeder mechanism 24; FIG. 16 is a front view thereof; and FIG. 17 is a rear view thereof. Referring to FIGS. 15 to 17, reference numeral 90 denotes a support frame which is detachably mounted in the lower housing unit 1B through pins 90*a*. Pivot levers 91A and 91B are rotatably supported at the outer surface portions of the side walls 90A and 90B of the support frame 90. The pivot levers 91A and 91B are rotatably mounted on a shaft 92 at its two ends. Each paper sheet is fed by mutual movement of feed members and engaging members. The paper feed members such as first paper feed rollers 93A and 93B are mounted at intermediate portions of the shaft 92 and are rotatable together therewith. The engaging members such as guide rollers 94A and 94B are rotatably mounted on the shaft 92 and are disposed to contact the inner surfaces of the side walls 90A and 90B respectively and lie outside the paper feed rollers 93A and 93B. The shaft 92 is rotated upon movements of the guide rollers 94A and 94B and the first paper feed rollers 93A and 93B. The pivot levers 91A and 91B are biased by tension coil springs 95A and 95B, respectively, and are pivoted downward within notches 90AA and 90BB formed in the side walls 90A and 90B, respectively. A drive gear 96 is mounted at the right-hand end of the shaft 92, as shown in FIG. 15. A sprocket 99 and an idler gear 98 which meshes with the drive gear 96 are rotatably mounted on a post 97 which is mounted on the side wall 90B and whose axis coincides with the pivotal axis of the pivot lever 91B. A first spring clutch 100 is disposed between the idler gear 98 and the sprocket 99. The first spring clutch 100 is constructed such that a clutch spring 100*a* having a substantially rectangular section is inserted in the outer surfaces of a boss 99*a* of the sprocket 99 and of a boss 98*a* of the idler gear 98, and such that a first ratchet sleeve 100*b* having teeth mesh with the outer surface of the clutch spring 100*a*. A leading portion 100*aa* of one end of the clutch spring 100*a* engages with an engaging hole 100*bb* of the first ratchet sleeve 100*b*. As shown in FIG. 17, a ratchet hook 101*a* is swingably disposed under the first ratchet sleeve 100*b* and can engage with the teeth of the first ratchet sleeve 100*b*. One end of the ratchet hook 101*a* is biased by a tension coil spring 101*b*, and the other end thereof is stopped at the teeth of the first ratchet sleeve 100*b*. A first solenoid 101*c* is disposed below the ratchet hook 101*a*. Upon energization of the first solenoid 101*c*, the ratchet hook 101*a* is separated from the first ratchet sleeve 100*b*. The clutch spring 100*a* and the first ratchet sleeve 100*b* are then free to move. When the sprocket 99 is rotated in the direction indicated by arrow J3 in FIG. 15, the clutch spring 100*a* is tightened. Upon friction between the bosses 98*a* and 99*a* and the clutch spring 100*a*, the rotational force of the sprocket 99 is transmitted to the idler gear 98. A sprocket 103 and an idler gear 104 are supported at an arm 90C of the frame 90 and are rotated together. A ladder chain 105 is looped around the sprockets 99 and 103 to transmit the driving force.

The driving section of the housing 1 which is connected to the idler gear 104 will be schematically described hereinafter. Referring to FIGS. 15 and 17, reference numeral 110 denotes a shaft for driving the aligning rollers 26. A boss 111 is disposed at the end of the shaft 110 and is rotated together therewith. A sprocket 113 and a drive gear 112 are disposed inwardly of the boss 111 and are driven by a driving source (not shown). A second spring clutch 114 is disposed between the boss 111 and the sprocket 113. The second spring clutch 114 has substantially the same structure as the first spring clutch 100. When the rotational force of the second ratchet sleeve 114*a* is not controlled, the rotational force of the drive gear 112 (in the direction indicated by arrow J1 in FIGS. 15 and 17) is transmitted to the shaft 110 through the boss 111. Referring to FIGS. 15 and 17, reference numeral 115 denotes a shaft for driving the paper feed rollers 25. A boss 116 is mounted at the end of the shaft 115 and is rotated together therewith. A sprocket 118 and a drive gear 120 are supported inwardly of the boss 116 and are rotated together. The sprocket 118 receives the driving force from the sprocket 113 through a ladder chain 117. The drive gear 120 transmits the driving force to the idler gear 104 through an intermediate gear 119. A third spring clutch 121 is disposed between the boss 116 and the sprocket 118. The third spring clutch 121 has substantially the same structure as the second spring clutch 114. When the rotational force of a third ratchet sleeve 121*a* is not regulated, the rotational force of the sprocket 118 (in the direction indicated by arrow J2 shown in FIGS. 15 and 17) is transmitted to the shaft 115 through the boss 116. It is noted that a ratchet lever 122 is disposed between the second and third spring clutches 114 and 121 and is free to swing in the direction indicated by arrow K in FIGS. 15 and 17 so as to regulate mutual movement of the second ratchet sleeve 114*a* and the third ratchet sleeve 121*a*. The ratchet lever 122 is biased by a tension coil spring 124, so that one end of the ratchet lever 122 serves to stop the third ratchet sleeve 121*a*. When a second solenoid 123 is energized, the ratchet lever 122 is rotated against the biasing force of the tension coil spring 124. One end of the ratchet lever 122 is separated from the third ratchet sleeve 121*a* and the other end thereof is moved to stop the second ratchet sleeve 114*a*.

The front side of the driving section in the housing 1 is shown in FIGS. 15 and 16. An idler gear 125 is rotatably disposed on the front side of the shaft 115 for driving the second paper feed rollers 25. A one-revolution spring clutch 126 is disposed outside the idler gear 125. When an actuator 127*b* biased by a biasing member 127*a* and stopped by a projection 126*b* of a sleeve 126*a* is moved outward upon energization of a paper feed solenoid 128 and is separated from the projection 126*b*, the spring clutch 126 transmits the rotational force of the shaft 115 to the idler gear 125, which is then rotated by one revolution. A drive gear 129 which meshes with the idler gear 125 is rotated together with the drive shaft 22*a* of the third paper feed rollers 22. The third paper feed rollers 22 receive the rotational force of the shaft 115 through, the drive gear 129, the spring clutch 126 and the idler gear 125 and are rotated in the direction indicated by arrow J5 in FIGS. 15 and 16.

Figure 18:
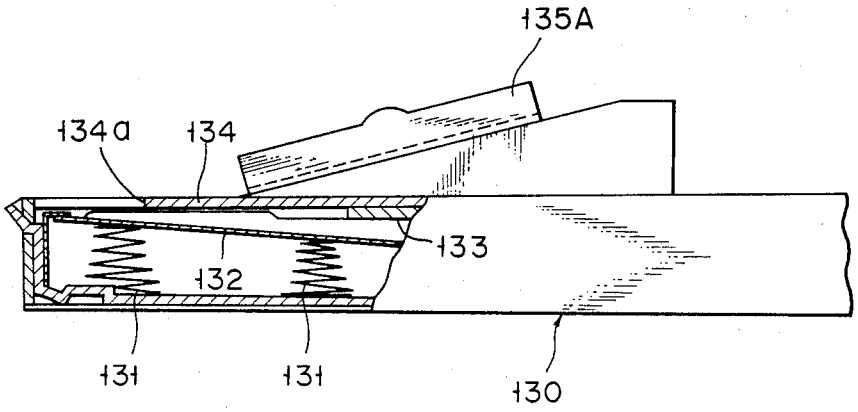
FIG. 18 is a partial side sectional view of the paper cassette with the manual feed function.
Figure 19:
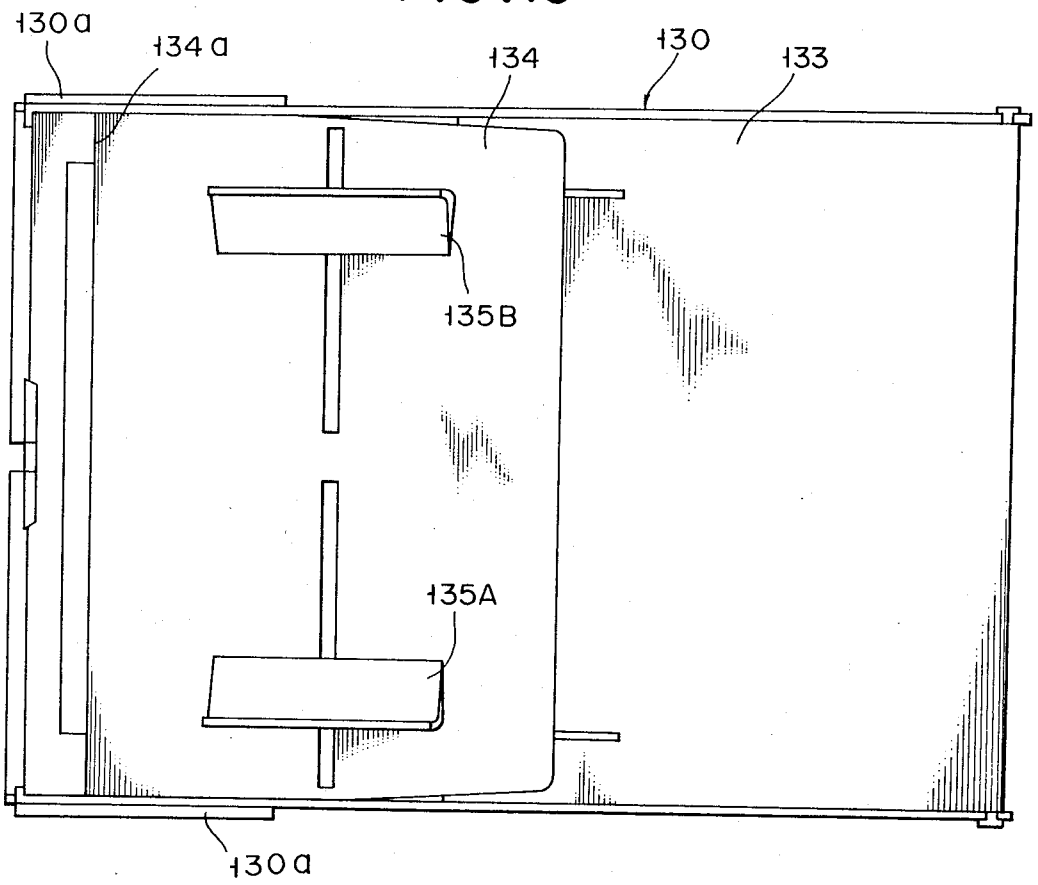
FIG. 19 is a plan view of the paper cassette shown in FIG. 18.
Figure 20:
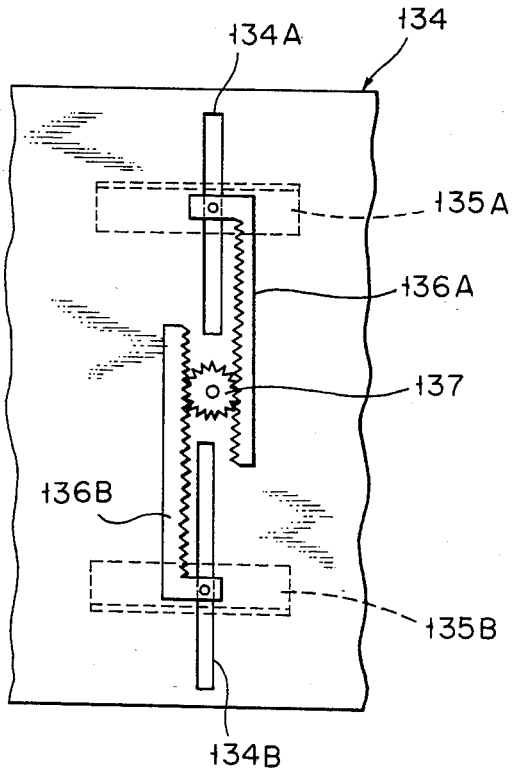
FIG. 20 is a detailed view showing part of the paper cassette shown in FIG. 18.

The paper cassette 23 having a manual feed function is detachably mounted on the paper feeder mechanism 24, and is shown in FIGS. 18 and 19. FIG. 18 is a side sectional view of the paper cassette 23; and FIG. 19 is a plan view thereof. Referring to FIGS. 18 and 19, reference numeral 130 denotes a box-shaped cassette housing. Projections 130*a* are formed at two sides of the cassette housing 130. The projections 130*a* respectively engage with guide portions 90*b* (FIGS. 15 and 16) mounted on the inner surfaces of the side walls 90A and 90B of the support frame 90 so as to detachably mount the cassette housing 130 in the frame 90. A backup plate 132 is disposed in the cassette housing 130 to urge the paper sheets in the cassette housing 130 upward in FIG. 18 through biasing members 131. A cassette cover 133 which is free to open/close is formed at part of the upper opening of the cassette housing 130. A manual guide 134 is disposed on the upper surface of the cassette cover 133 and is movable along the cassette housing 130, that is, along the feed direction of the paper sheet by means of the first paper feed rollers 93A and 93B. When the manual guide 134 is moved in the direction indicated by arrow L in FIG. 16, a leading edge 134*a* of the manual guide 134 does not come into contact with the first paper feed rollers 93A and 93B or the guide rollers 94A and 94B all of which are biased downward through the pivot levers 91A and 91B and the tension coil springs 95A and 95B, respectively. Only the first paper feed rollers 93A and 93B come into contact with the uppermost paper sheet in the cassette housing 130. However, when the manual guide 134 is moved in the direction indicated by arrow M in FIG. 16, the leading edge 134*a* of the manual guide 134 causes the guide rollers 94A and 94B to lift against the biasing force of the tension coil springs 95A and 95B, so that the first paper feed rollers 93A and 93B are separated from the uppermost paper sheet in the cassette housing 130. A pair of regulation guides 135A and 135B are disposed on the upper surface of the manual guide 134 to regulate and guide the two sides of the paper sheet which is to be manually fed. The structure of the regulation guides 135A and 135B is shown in FIG. 20. The regulation guides 135A and 135B are movably fitted in a pair of elongated holes 134A and 134B, respectively. Rack gears 136A and 136B oppose each other and respectively correspond to the regulation guides 135A and 135B. A pinion gear 137 which meshes with the rack gears 136A and 136B is provided to be rotatable. When one of the regulation guides is moved, the other one thereof is symmetrically moved about the pinion 137. As a result, width adjustment of the regulation guides 135A and 135B can be easily performed.

In the paper feeder apparatus 20, a guide only for manual feed (not shown) may be mounted in place of the paper cassette 23 and the paper feeder mechanism 24.

Main switches, a control device, and a display unit for indicating the cassette selection and copying conditions of the paper feeder apparatus 20 will be described with reference to the accompanying drawings including FIGS. 21 and 22. Referring to FIG. 1, a manual feed switch 138*a* is arranged before the second paper feed rollers 25 when viewed along the paper feed direction. When the leading edge of the paper sheet fed by the manual guide 134 or a guide only for manual feed (not shown) abuts against the manual feed switch 138*a*, a driving source (not shown) and the second solenoid 123 are actuated, and then the second paper feed rollers 25 are driven. Furthermore, referring to FIG. 1, a start switch 138*b* for manual feed only is arranged before the aligning rollers 26 when viewed along the paper feed direction. The start switch 138*b* has substantially the same function as that of a copy start button (not shown) of the copying machine. When the leading edge of the paper sheet contacts the start switch 138*b*, copying processes such as exposure, charging and development are started. A paper start detecting magnet switch 145B to be described later is turned on to drive the aligning rollers 26. Therefore, the copying processes are performed in synchronism with the rotation of the photosensitive drum 2. When the manual guide 134 is located in the position shown in FIG. 16, a microswitch 140 is turned on by bringing the shaft 92 into contact with an actuator 140*a*. The microswitch 140 is arranged in the paper feeder mechanism 24, as shown in FIG. 17. An output from the microswitch 140 is supplied as a selection signal to a selection control section 150 when the paper cassette 23 and the corresponding paper feeder mechanism 24 are mounted. The selection signal indicates whether the paper cassette 23 or the paper cassette 21 is selected.

Figure 21:
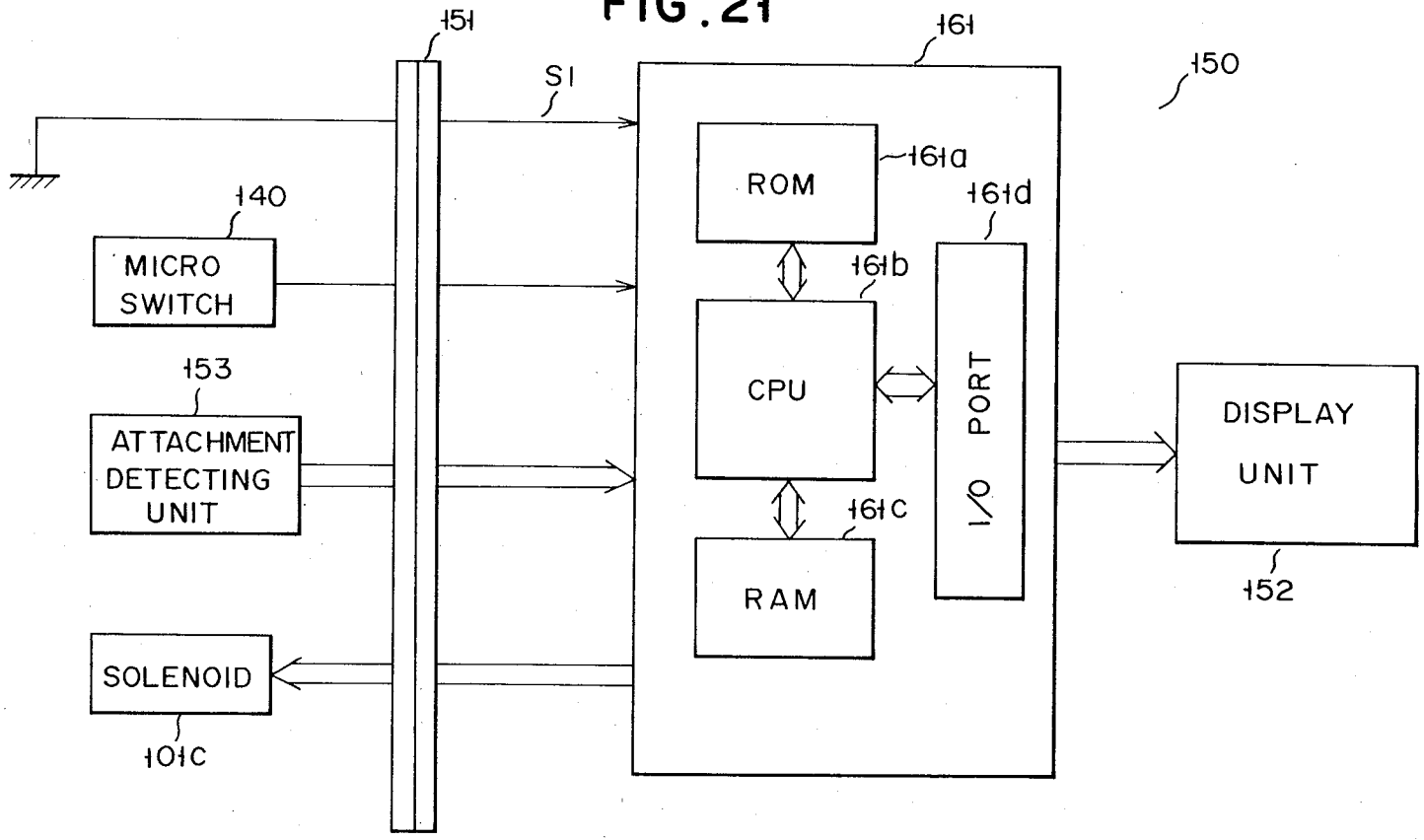
FIG. 21 is a block diagram of a selection control section.
Figure 22:
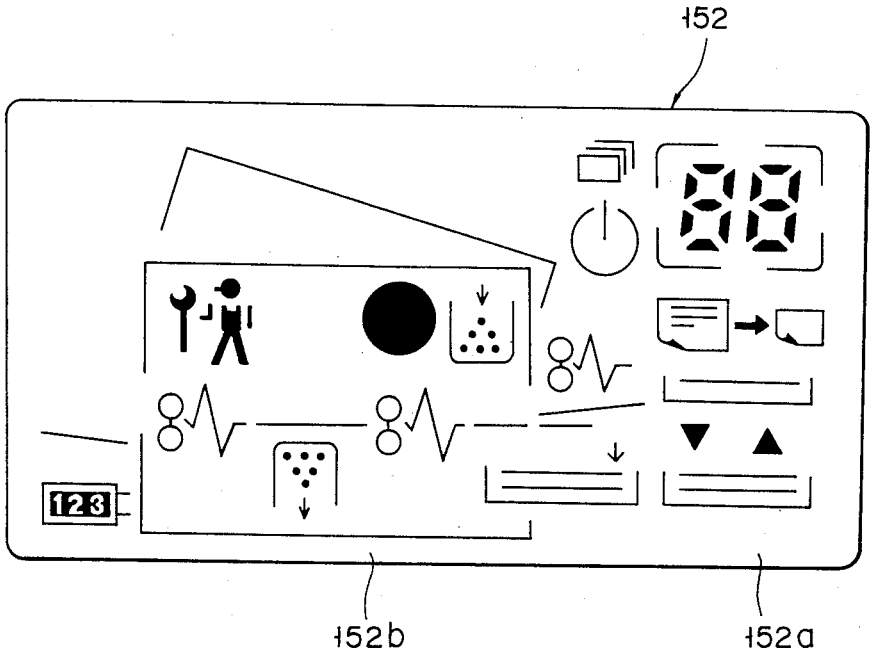
FIG. 22 is a schematic view of a display unit.

The selection control section 150 is arranged such that the central control device 161 is electrically free to couple to the paper feeder mechanism 24 through a connector 151 as shown in FIG. 21. The central control device 161 is connected to a display unit 152 which includes a selection condition display section 152*a* and a copying condition display section 152*b*. The display unit 152 (to be referred to also as a control panel 152) comprises liquid crystal display elements for displaying some of the display contents shown in FIG. 22. When the central control device 161 is connected to the paper feeder mechanism 24 through the connector 151, a display changeover signal S1 which is biased to the ground is supplied to the central control device 161. As a result, the central control device 161 controls the display unit so as to perform display at the display section 152*a*. However, when the paper feeder mechanism 24 is not mounted, only the paper cassette 21 may be selected. Therefore, no display is performed to confuse the user concerning selection between paper cassettes. In this case, the display changeover signal S1 biased to the ground since the paper cassette 23 is not mounted, is not supplied to the central control device 161. In this manner, the central control device 161 controls the display unit 152 so as not to display the cassette selection data.

In the above embodiment, the display changeover signal S1 is supplied to the central control device 161 which then controls the display unit 152. However, the display changeover signal S1 may be directly supplied to a display driver (not shown) in the display unit 152 which is then controlled thereby. Furthermore, when the paper cassette 23 is mounted on the paper feeder mechanism 24, an output from an attachment detecting unit 153 arranged in the paper feeder mechanism 24 is supplied to the central control device 161. One of the paper cassettes 21 and 23 is selected in accordance with the output from the microswitch 140. In other words, when the manual guide 134 is moved in the direction indicated by arrow L in FIG. 16, the microswitch 140 is turned on. The output from the microswitch 140 is supplied to the central control device 161. When the operator presses the copy start button (not shown), a paper sheet is picked up from the cassette housing 130 of the paper cassette 23. In this case, the paper sheet cannot be manually fed from the manual guide 134 due to the mechanical structure of the paper cassette 23 and the corresponding paper feeder mechanism 24. However, when the manual guide 134 is moved in the direction indicated by arrow M in FIG. 16, the shaft 92 is separated from the actuator 140*a* of the microswitch 140, thereby turning off the microswitch 140. When the operator presses the copy start button (not shown), a paper sheet can be picked up from the paper cassette 21. The operator can manually feed the paper sheet through the manual guide 134. In this manner, the paper cassettes 21 and 23 can be selected according to the position of the manual guide 134. When the detection signal from the attachment detecting unit 153 is not supplied to the central control device 161 (that is, the paper cassette 23 is not mounted), the paper sheet is always fed from the paper cassette 21 upon depression of the copy start button (not shown). The first solenoid 101*c* is energized to feed a paper sheet from the cassette housing 130 of the paper cassette 23.

The central control device 161 comprises a microcomputer. The microcomputer comprises a read-only memory (ROM) 161*a* which stores a control program indicated by the flow charts in FIGS. 27A to 33F, a random access memory (RAM) 161*c* used as a work area, an I/O port 161*d* for interfacing between input/output devices and the central control device 161, and a central processing unit (CPU) 161*b* which is connected to the I/O devices to perform various types of operation. The 4-bit microcomputer TMP4320AP (TOSHIBA Corporation, Kawasaki-city, Japan) can be used as the microcomputer of the above embodiment.

The mode of operation of the paper feeder apparatus 20 will be described with reference to FIGS. 20 to 23.

Figure 23:
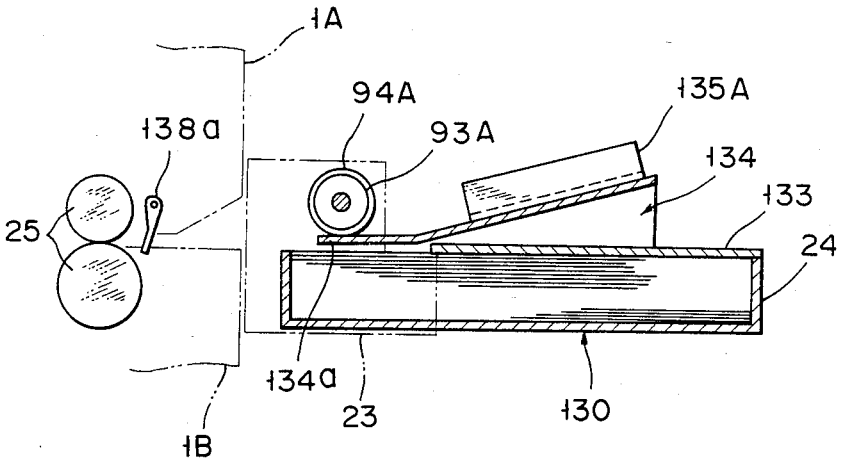
FIG. 23 is a view for explaining the mode of operation of the paper feeder apparatus.

A case will be described in which the paper cassette 23 and the paper feeder mechanism 24 are mounted in the housing 1. In order to feed a paper sheet from the cassette housing 130 of the paper cassette 23, the manual guide 134 is moved in the direction indicated by arrow L as shown in FIG. 16. In this condition (also shown in FIG. 1), the first paper feed rollers 93A and 93B are in contact with the uppermost paper sheet in the cassette housing. When the operator presses the copy start button, power from the power source (not shown) in the housing 1 is transmitted to the sprocket 99 through the drive gear 112, the sprocket 113, the ladder chain 117, the sprocket 118, the drive gear 120, the intermediate gear 119, the idler gear 104, the sprocket 103 and the ladder chain 105. At the same time, the second solenoid 123 is energized to separate the ratchet lever 122 from the third ratchet sleeve 121*a*, so that the rotational force of the sprocket 118 is transmitted to the second paper feed rollers 25 through the third spring clutch 121. Further, the first solenoid 101*c* is energized to separate the ratchet hook 101*a* from the first ratchet sleeve 100*b*, thereby transmitting the rotational force of the sprocket 99 to the idler gear 98 and the drive gear 96. The first feed rollers 93A and 93B are rotated in the direction indicated by arrow J4 in FIG. 15 and pick up the uppermost paper sheet in the cassette housing 130 by friction between the first feed rollers 93A and 93B and the paper sheet. The paper sheet is then conveyed through the second paper feed rollers 25, and the leading edge of the paper sheet abuts against the nip portions of the aligning rollers 26. After the paper sheet is fed and when the paper start detecting magnet switch 145B is turned on, the second solenoid 123 is energized to separate the ratchet lever 122 from the second ratchet sleeve 114*a*. The ratchet lever 122 then comes in contact with the third ratchet sleeve 121*a*. The rotational force of the drive gear 112 is transmitted to the shaft 110 through the second spring clutch 114. The aligning rollers 26 are then rotated. The paper sheet which contacts the aligning rollers 26 is then conveyed to the transfer charger 27. However, when the operator feeds the paper sheet from the manual guide 134, he moves the manual guide 134 in the direction indicated by arrow M in FIG. 16. Upon this operation, the first paper feed rollers 93A and 93B are separated from the uppermost paper sheet in the cassette housing 130. Therefore, the operator can easily manually feed a paper sheet (FIG. 23). The paper feed operation from the manual guide 134 is substantially the same as that from the cassette housing 130, except for the following points. In the manual feed, the operator need not press the copy start button (not shown). The leading edge of the paper sheet from the manual guide 134 causes the manual feed switch 138*a* to operate, thereby rotating the second paper feed rollers 25. Furthermore, since the microswitch 140 is not turned on, the first paper feed rollers 93A and 93B may not be rotated through the first spring clutch 100. When the leading edge of the paper sheet comes into contact with the manual feed start switch 138*b*, the copying processes such as exposure, charging and development can be initiated. At the same time, the aligning rollers 26 are rotated through the second spring clutch 114, thereby completing paper feed. When the operator presses the copy start button (not shown) when the manual guide 134 is moved in the direction indicated by arrow M in FIG. 16, a paper sheet can be fed from the paper cassette 21. Specifically, when the operator presses the copy start button (not shown), power from the driving source (not shown) in the housing 1 is transmitted to the sprocket 118 through the drive gear 112 in the same manner as described above. At the same time, upon energization of the second solenoid 123, the rotational force of the sprocket 118 is transmitted to the shaft 115 through the third spring clutch 121. Furthermore, upon energization of the paper feed solenoid 128, the rotational force of the shaft 115 is transmitted to the third paper feed roller 22 through the spring clutch 126 or the like. The third paper feed roller 22 is then rotated by one revolution in the direction indicated by arrow J5 in FIGS. 1, 15 and 16, thereby feeding the paper sheet. The leading edge of the paper sheet abuts against the nip portions of the aligning rollers 26. When the paper start detecting magnet switch 145B is started after paper feed, the second solenoid 123 is de-energized to separate the ratchet lever 122 from the second ratchet sleeve 114*a*. The ratchet lever 122 then comes into contact with the third ratchet sleeve 121*a*. The rotational force of the drive gear 112 is thus transmitted to the shaft 110. As a result, the aligning rollers 26 are rotated, and the paper sheet is conveyed to the transfer charger 27.

When the paper cassette 23 and the corresponding paper feeder mechanism 24 are not mounted and when the operator presses the copy start button (not shown), a paper sheet is fed from the paper cassette 21 in the same manner as described above. When the operator feeds the paper sheet in the guide for manual feed only (not shown), paper feed can be performed in the same manner as manual feed from the manual guide 134.

Figure 24:
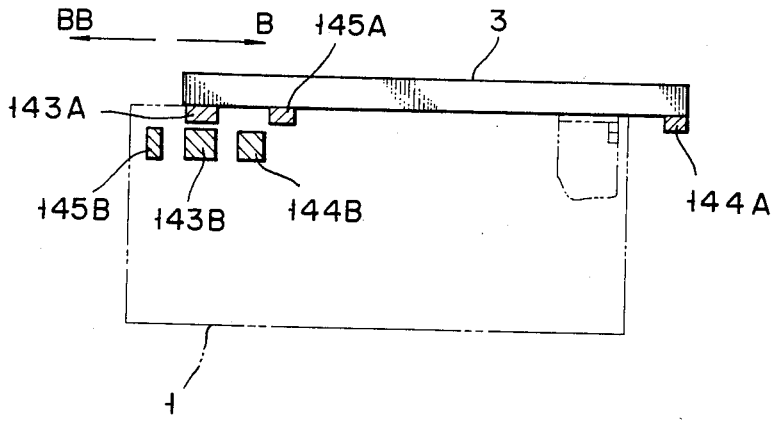
FIG. 24 is a schematic front view of the copying machine when its document table is located at the home position.
Figure 25:
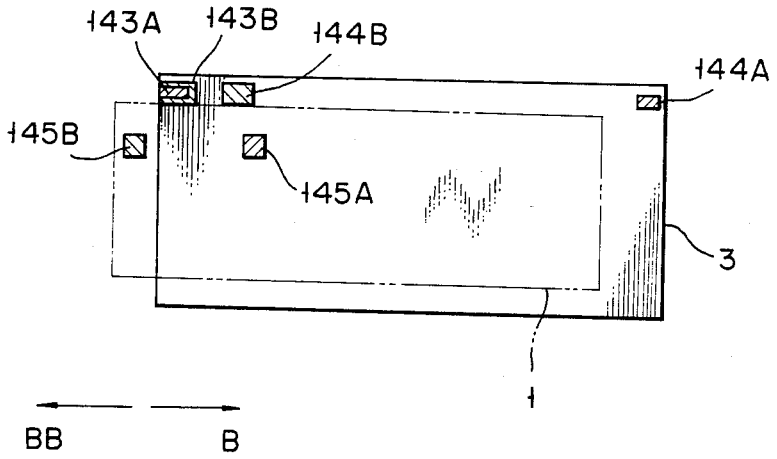
FIG. 25 is a schematic plan view of the copying machine shown in FIG. 24.

The document table 3 will be described mainly with reference to FIG. 1 as well as FIGS. 24 and 25. FIG. 24 is a schematic front view of the copying machine in which the document table 3 is located in the home position; and FIG. 25 is a schematic plan view thereof. The position of the document table 3 which is indicated by the solid line in FIG. 1 is the home position. A home position detecting magnet 143A is arranged at the left end of the document table 3. A home position detecting magnet switch 143B is arranged on the rear surface of the upper housing unit 1A and is located below the home position detecting magnet 143A. The position of the document table 3 which is indicated by the two dash line in FIG. 1 is the limit position of the direction indicated by arrow BB in FIG. 1. A limit position detecting magnet 144A is disposed at the right end of the document table 3. A limit position detecting magnet switch 144B is mounted on the rear surface of the upper housing unit 1A to detect the limit position detecting magnet 144A at the limit position. A paper start magnet 145A is disposed on the lower surface of the document table 3. A paper start detecting magnet switch 145B is arranged to detect the paper start magnet 145A, thereby driving the aligning rollers 26. The document table 3 is driven in the forward direction (direction indicated by arrow BB in FIGS. 1, 24 and 25) and the reverse direction (direction indicated by arrow B in FIGS. 1, 24 and 25) respectively by clutches CLF and CLB which transmit power from the driving source (not shown). Specifically, the document table 3 is moved in the direction indicated by arrow BB in FIG. 1 after the home position detecting magnet switch 143B detects the home position detecting magnet 143A through the main control device 161. When the operator presses the copy start button (not shown) while the document table 3 is not located in the home position, the document table 3 is first moved in the direction indicated by arrow B in FIG. 1. After the document table 3 is set in the home position, it is then moved in the direction indicated by arrow BB in FIG. 1. Furthermore, after the operator opens the hopper cover 13*a* of the toner hopper 13 and replenishes it with the toner, the operator need not restore the document table 3 to the home position and performs copying, thus greatly improving operability.

Figure 27A:
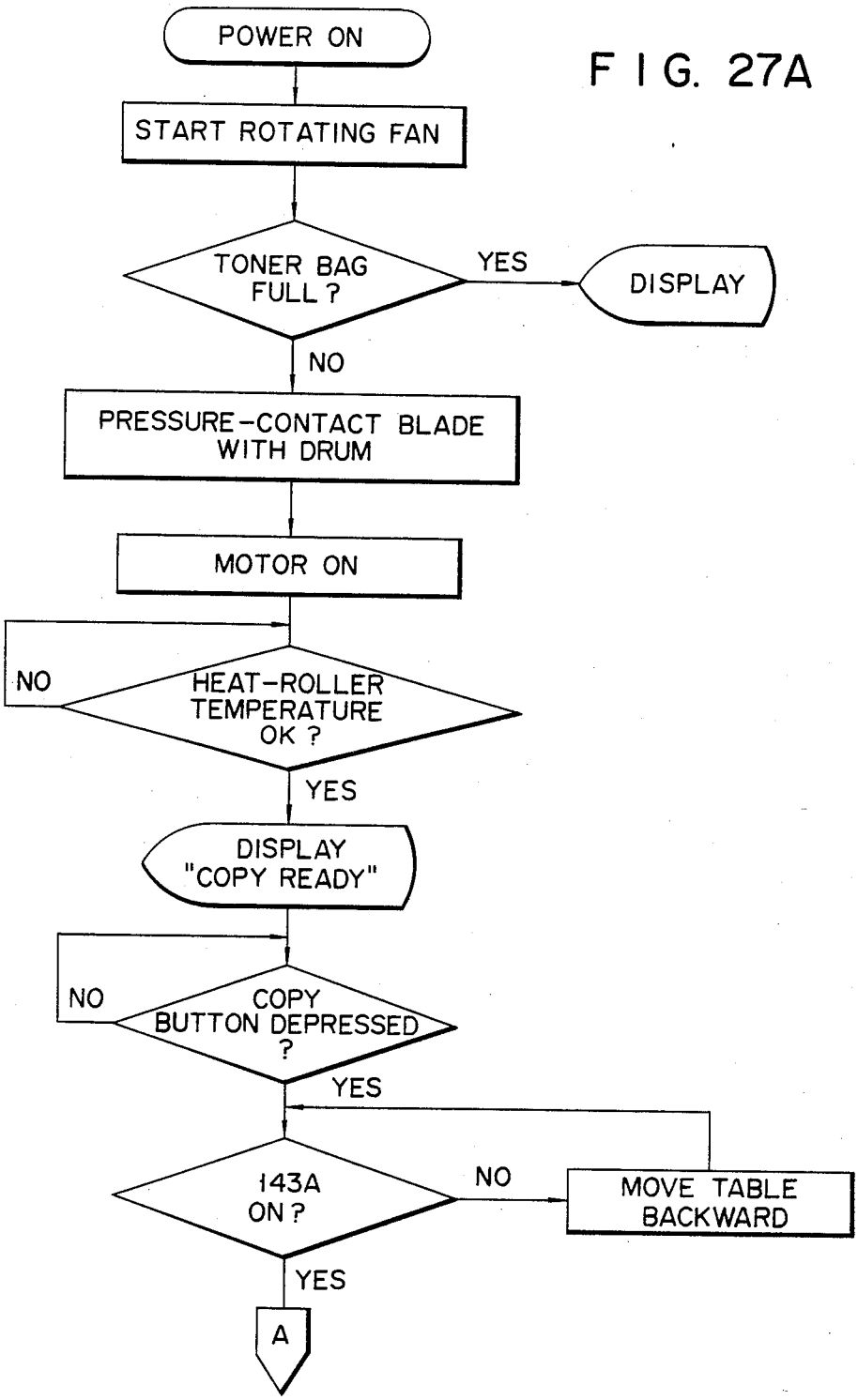
FIGS. 27A and 27B are flow charts for explaining the mode of operation for table movement.
Figure 27B:
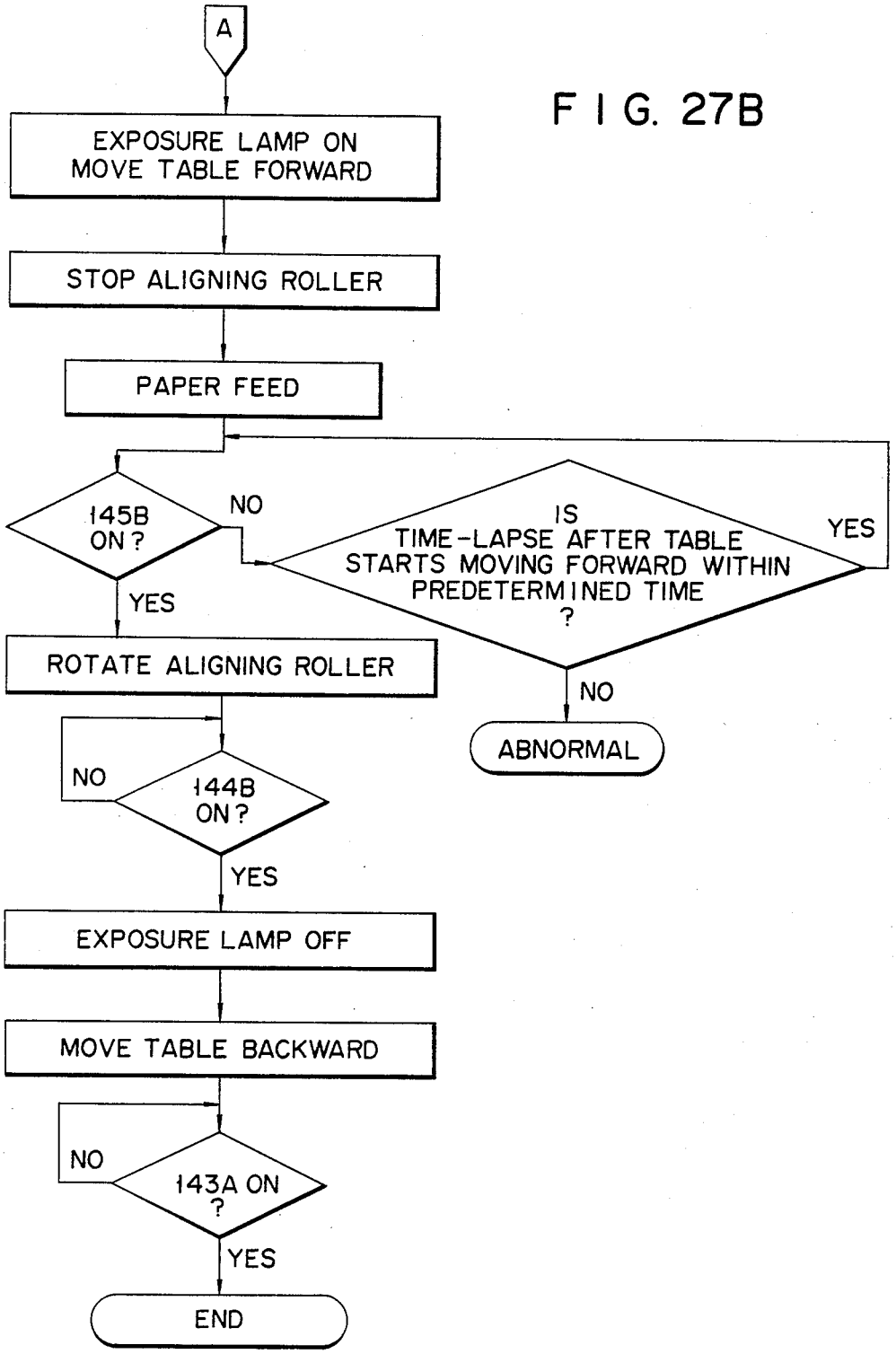

The configuration and operation of the central control device 161 will be described with reference to FIGS. 26, 27A and 27B. Referring to FIG. 26, the central control device 161 receives outputs from the detecting magnet switches 13*c*, 143B, 144B and 145B. Specifically, when the output from the home position detecting magnet switch 143B is received, the central control device 161 determines that the document table 3 is located in the home position. When the output from the paper start detecting magnet switch 145B is supplied to the central control device 161, the aligning rollers 26 are driven. When the output from the limit position detecting magnet switch 144B is supplied to the central control device 161, the document table 3 is driven in the reverse or backward direction. When the output from the magnet switch 13*c* is supplied to the central control device 161, the reverse movement of the document table is prohibited. A counter 162 is provided to produce an output after 10 ms has elapsed from the beginning of counting. When the output from the counter 162 is supplied to the central control device 161, the device 161 performs an interrupt program. It is noted that the central control device 161 is connected to control the photosensitive drum 2, the document table 3, the exposure lamp 4, the exposure unit 8, the charger 11, the developing unit 12, the fixing unit 36 and the cleaning unit 29.

Figure 28:
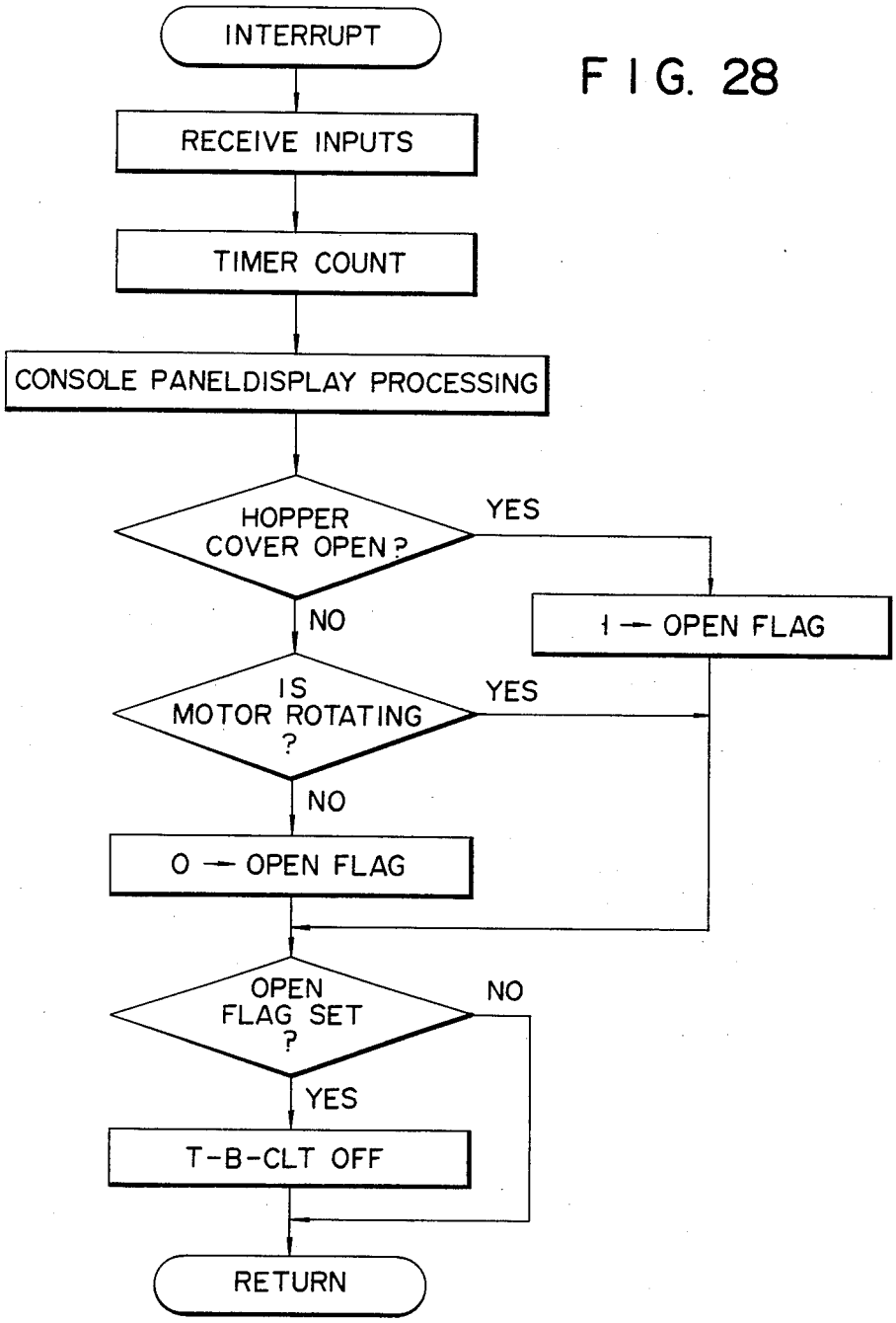
FIG. 28 is a flow chart for explaining the interrupt operation.

The interrupt program is executed in accordance with the flow chart shown in FIG. 28. The interrupt subroutine is executed every 100 ms during the main routine. In the subroutine, it is checked whether or not the hopper cover 13*a* is opened in accordance with the ON/OFF condition of the magnet switch 13*c*. In accordance with the detection result, it is determined that the forward (reverse) movement of the document table 3 is stopped. All inputs are received, and the timer is started. After the display is performed at the control panel 52, it is checked whether or not the hopper cover 13*a* is opened. If YES, the "OPEN" flag is set to logic level "1". However, if it is determined that the hopper cover 13*a* is not open, it is checked whether or not the motor is rotated. If NO in the above step, the "OPEN" flag is set to logic level "0". However, when the "OPEN" flag is set to logic level "1" or when it is determined that the motor is being rotated, it is again checked whether or not the "OPEN" flag is set to logic level "1". If YES in the above step, the document table backward drive clutch (T-B-CLT) is turned off. However, if it is determined that the "OPEN" flag is not set to logic level "1", the interrupt subroutine is ended to re-execute the main routine.

The overall mode of operation of the paper feeder apparatus will be described in accordance with the flow charts in FIGS. 29A to 33F. In a further description, the manual feed switch 138*a*, the manual start switch 138*b*, the second solenoid 123, the document table backward drive clutch CLB, the document table forward drive clutch CLF, the paper cassette 23, the paper cassette 21, the copy start button (not shown), the solenoid 75, the solenoid 128, the charger 11, the second paper feed rollers 25, the third paper feed roller 22, the paper start detecting magnet switch 145B, the vicinity of the transfer charger 27, the fixing unit 36, the first solenoid 101*c*, the first paper feed rollers 93A and 93B are respectively designated by M-F-SW 138*a* (manual feed switch), M-STR-SW 138*b* (manual start switch), P-STR-SOL 123 (paper start solenoid), T-B-CLT (table back clutch), T-FWD-CLT (table forward clutch), an optional cassette 23, an automatic paper cassette 21 (or simply cassette 21), a print key or start key (not shown), BLD-SOL 75 (blade solenoid), P-FEED-SOL 128 (paper feed solenoid), HVT-M 11 (development bias), manual feed rollers 25, a feed roller 22, a paper start switch 145B, a transfer section, a fixer 36, OP-FEED-SOL 101*c* (optional feed solenoid), and optional feed rollers 93A and 93B.

Figure 29A:
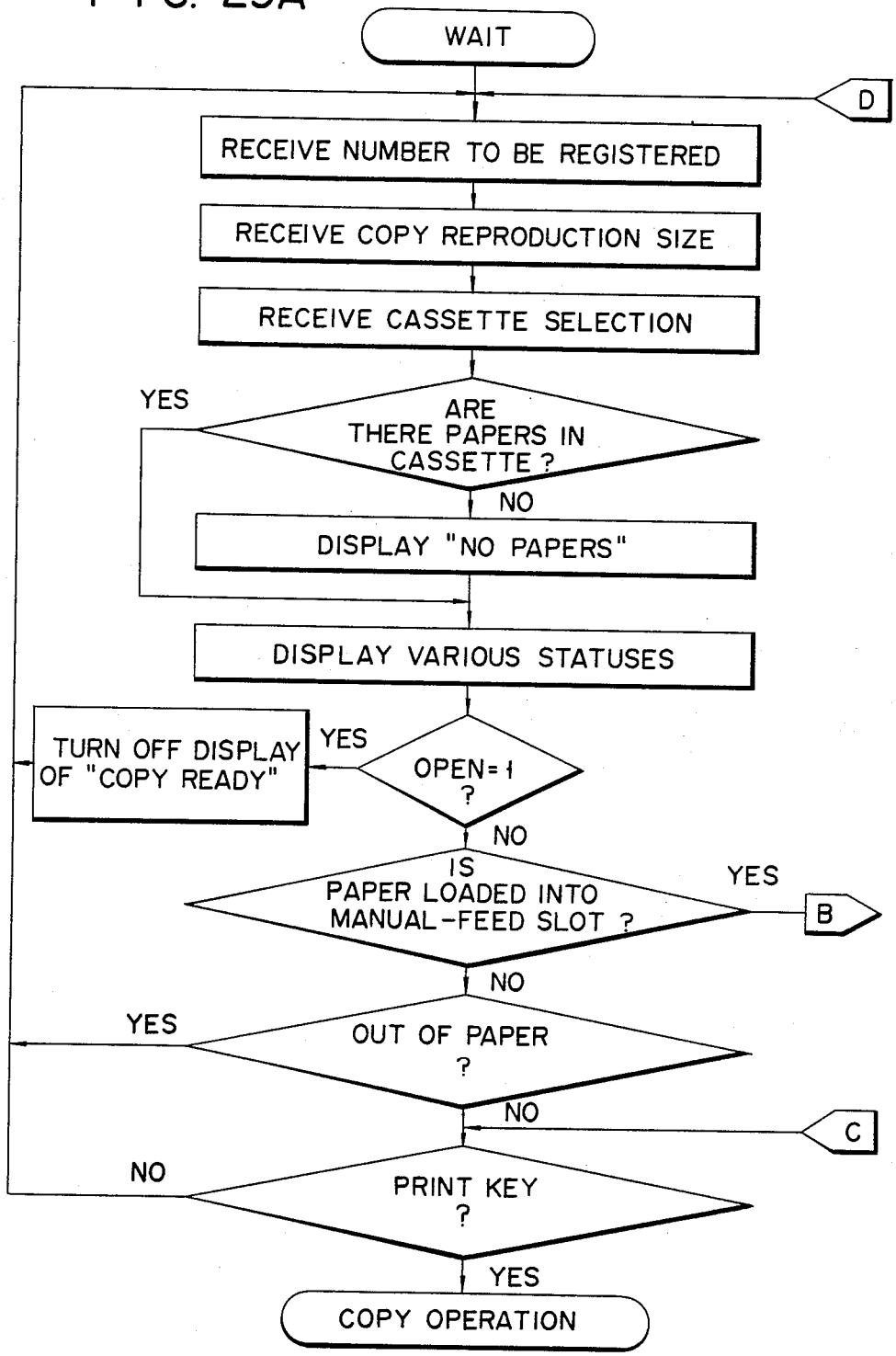
Figure 29B:
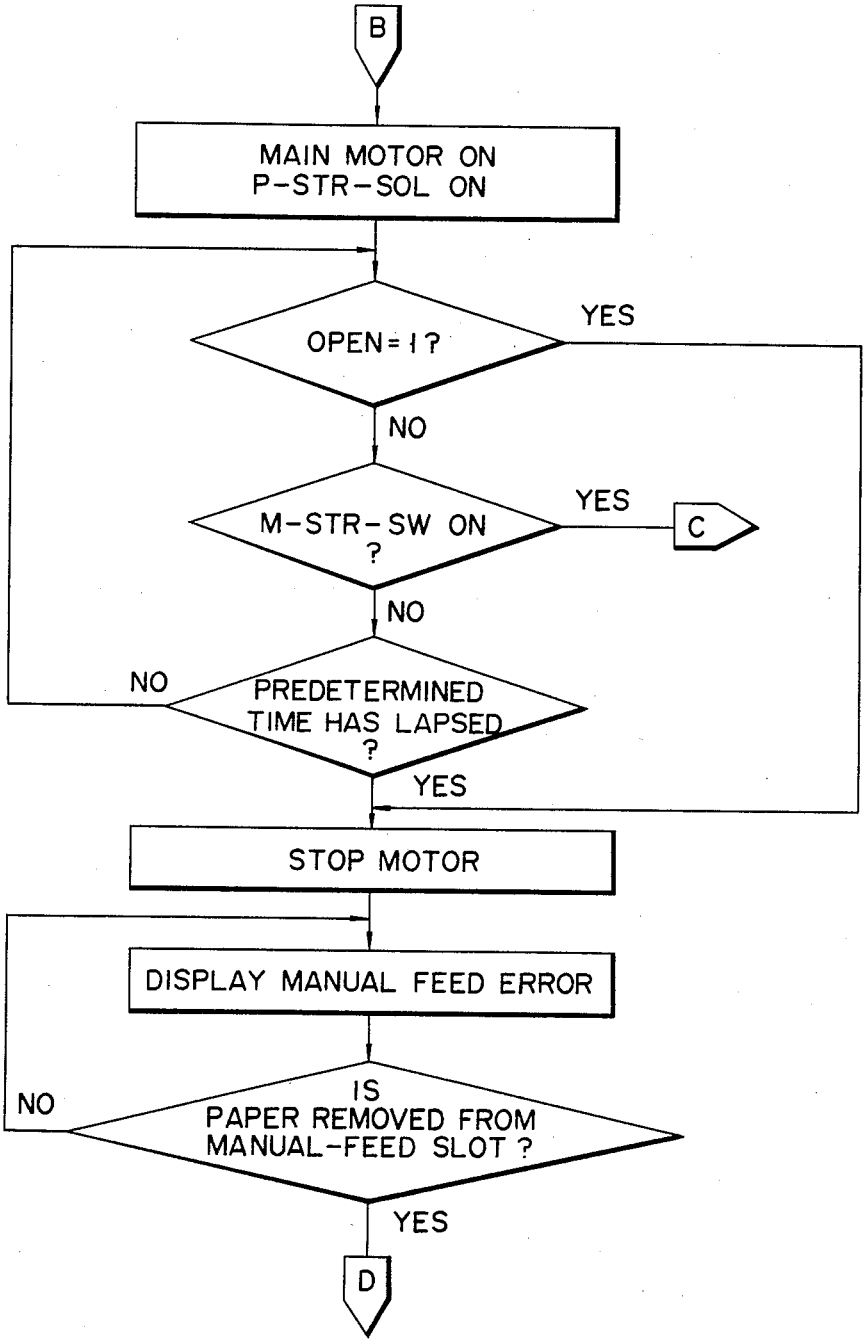

The standby operation around the paper feeder mechanism until the copying operation is initiated will be described with reference to the flow charts in FIGS. 29A and 29B. Copying number data entry, magnification data entry, and cassette selection data entry are performed. In the cassette selection operation, when the optional cassette 23 is mounted, only the optional cassette 23 is selected and the automatic paper cassette 21 is not selected. When the optional cassette is mounted and the manual guide 134 is moved in the direction indicated by arrow M in FIG. 16, the automatic paper cassette 21 is selected but the optional cassette 23 is not selected. In this manner, the cassette selection operation is completed, and it is then checked whether or not the paper sheets are present in the selected cassette. If NO in the above step, "NO PAPERS" is displayed. However, if it is determined the paper sheets are present in the cassette or when the paper sheets are filled in the cassette, various statuses are displayed. It is then checked whether or not the "OPEN" flag which indicates the opening/closing of the hopper cover 13*a* is set to logic level "1". If YES, "COPY READY" sign goes off. The routine returns to the initial step. However, when the "OPEN" flag is not set to logic level "1", it is then checked whether or not the paper sheet is inserted in the manual feed slot in accordance with the status of the M-F-SW 138*a*. In this case, when the optional cassette 23 is selected, manual feed is not performed. However, when the optional cassette 23 is not selected (that is, when the manual guide is moved in the direction indicated by arrow M in FIG. 16 even if the optional cassette 23 is mounted, or when the optional cassette 23 is not mounted), the operator can feed the paper sheet using the manual guide or the guide for manual feed only (not shown). The guide for manual feed only is referred to as a manual feed table. When a paper sheet is present in the manual feed slot, the main motor and the P-STR-SOL 123 are ON. It is then checked whether or not the "OPEN" flag is set to logic level "1". If YES, the motor is stopped, and "MANUAL FEED ERROR" sign is displayed. It is then checked whether or not the paper sheet is removed from the manual feed slot. The routine returns to the initial step. However, if it is determined that the "OPEN" flag is not set to logic level "1", it is then checked whether or not the M-F-SW 138*a* is ON. If YES, the copying operation steps are executed. However, if it is determined that the M-STR-SW 138*b* is not ON, the motor is stopped when a predetermined time has elapsed. Thereafter, steps for displaying the "MANUAL FEED ERROR" sign are executed.

If it is determined that the paper sheet is not present in the manual feed slot, it is checked whether or not the paper sheets are absent in the cassette. If NO, it is determined that automatic paper feed status is initiated. It is then checked whether or not the print or copy key is pressed. If YES, the next copy process steps are executed.

Figure 30A:
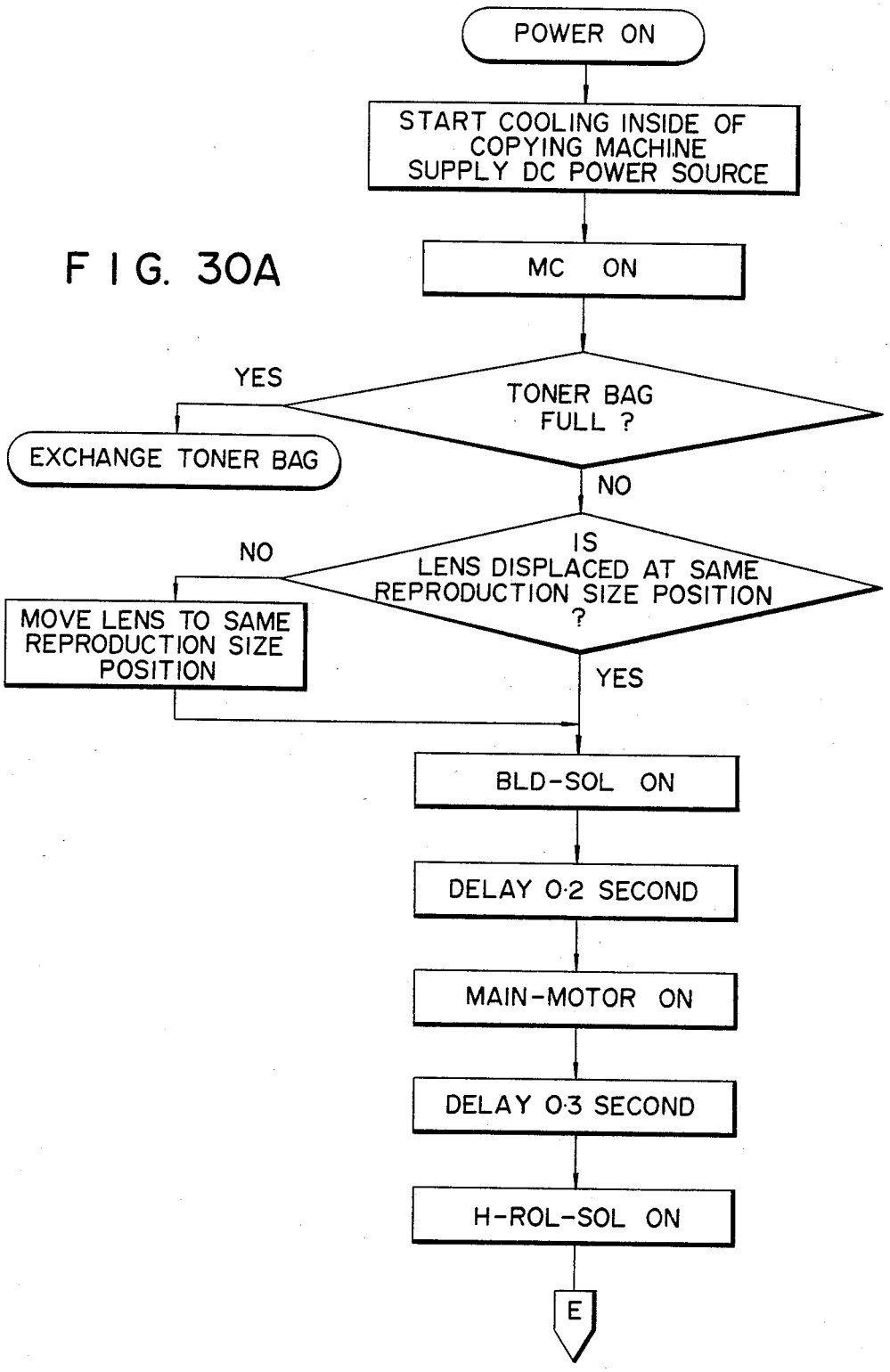
FIGS. 30A to 30C are flow charts for explaining the operation of the peripheral units from the power ON time to the end of the standby operation of the peripheral units.
Figure 30B:
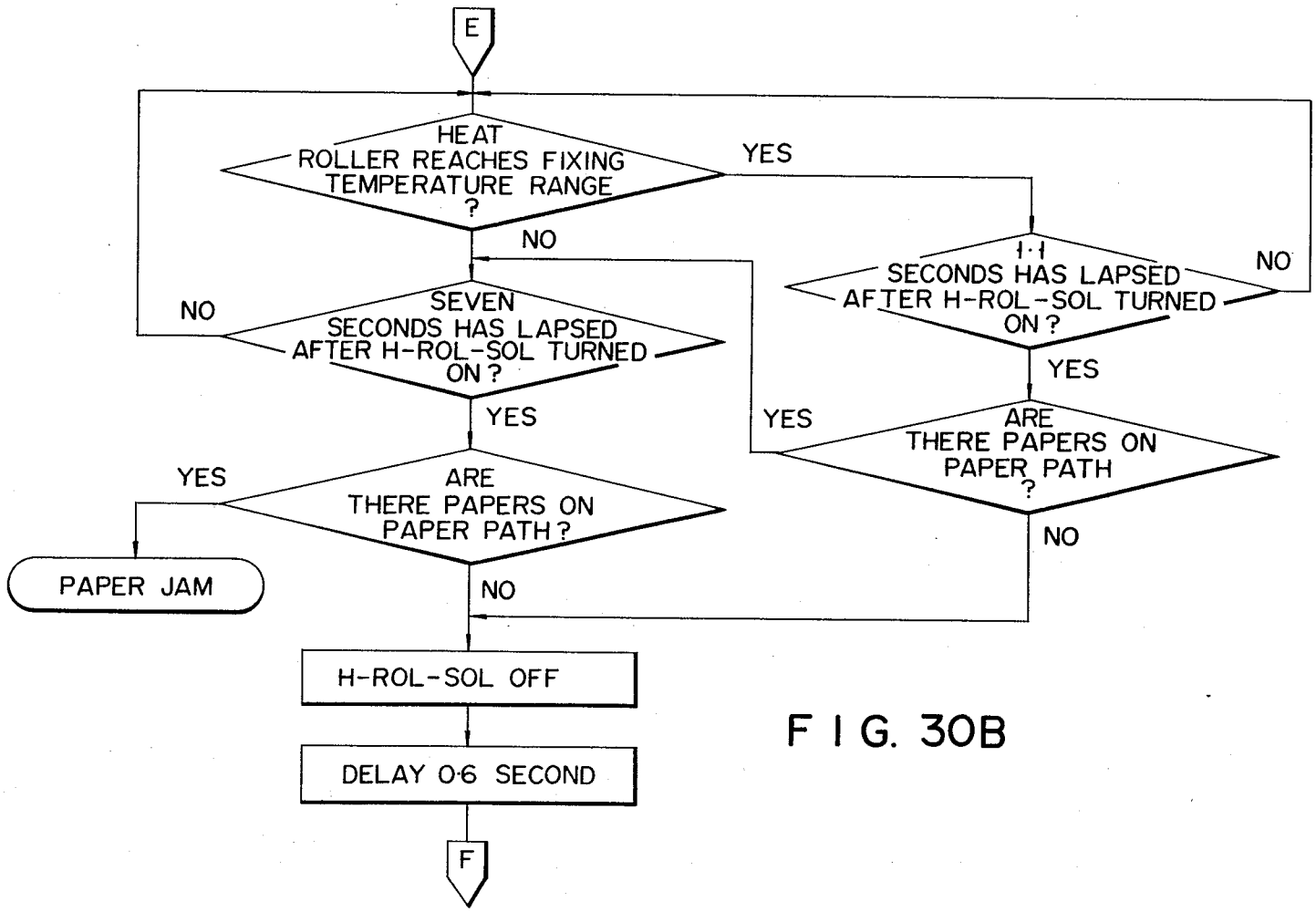
Figure 30C:
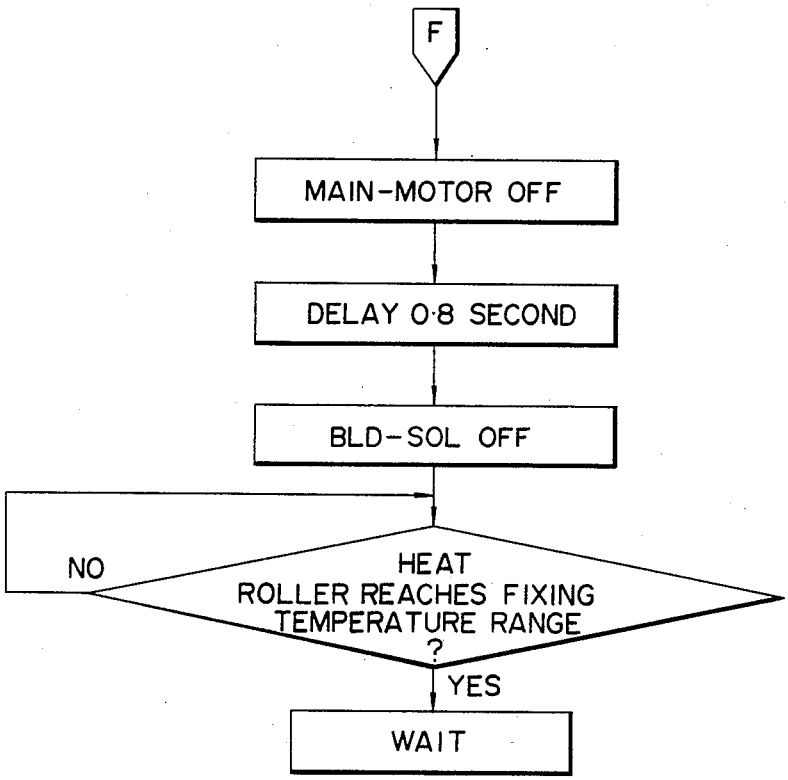
Figure 31A:
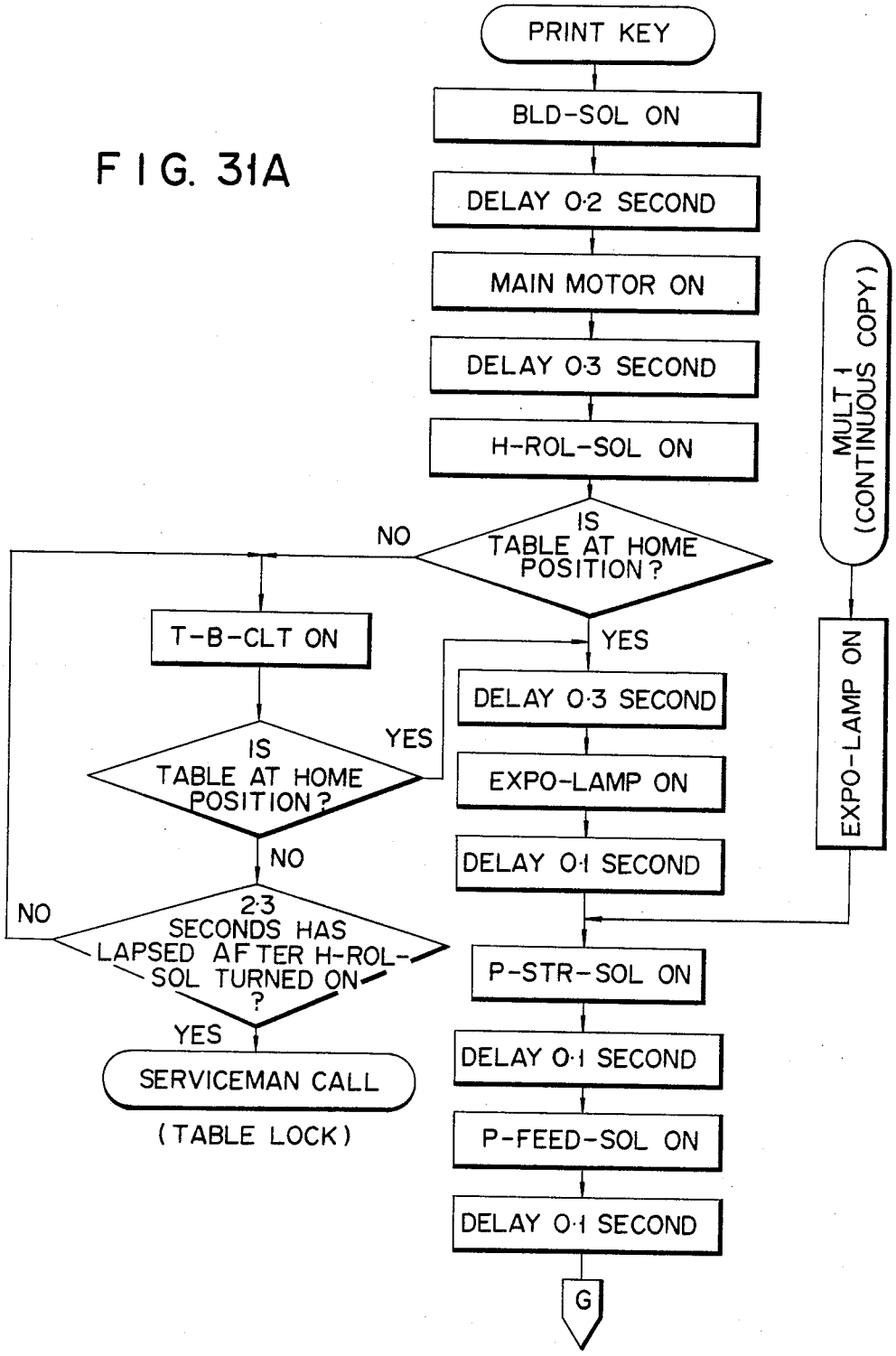
FIGS. 31A to 31F are flow charts for explaining the copying operation using automatic paper feed.
Figure 31B:
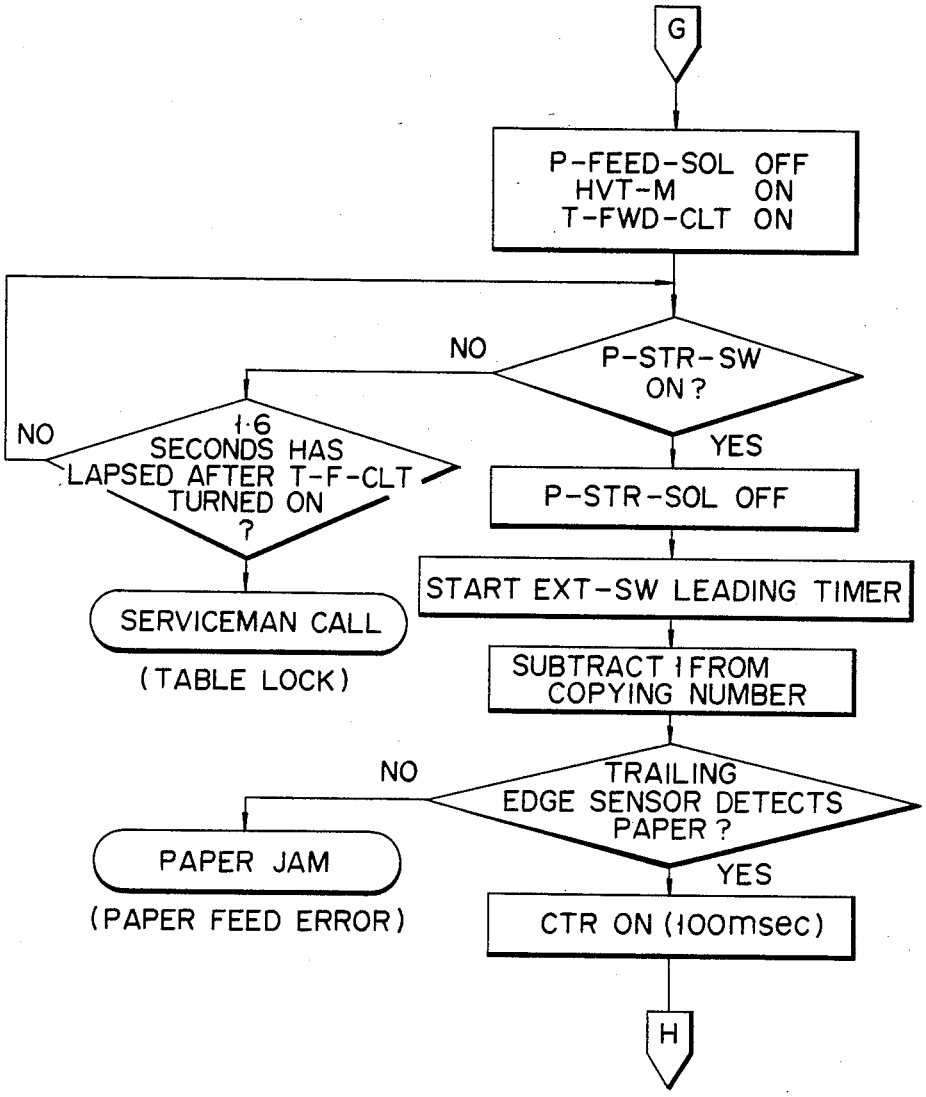
Figure 31C:
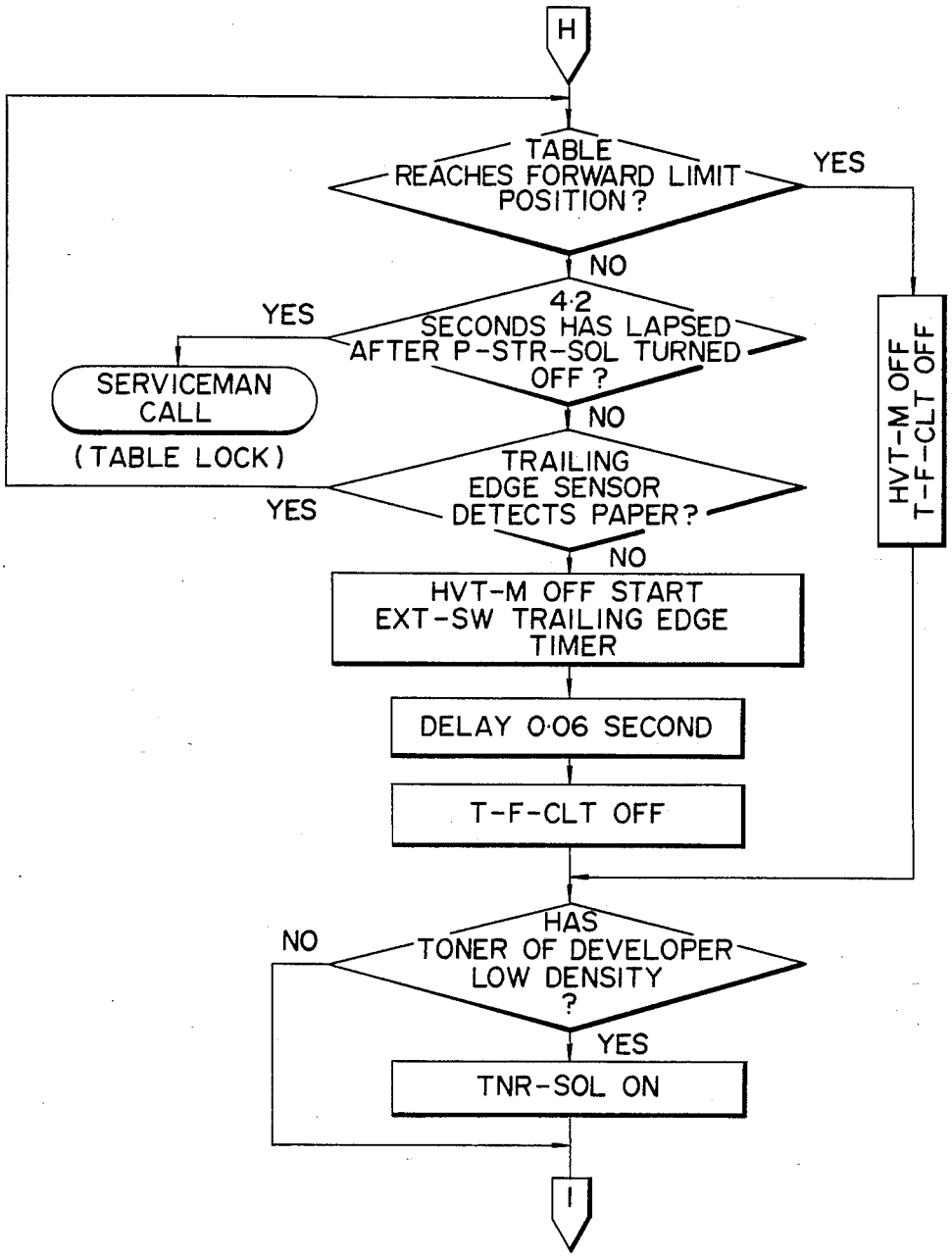
Figure 31D:
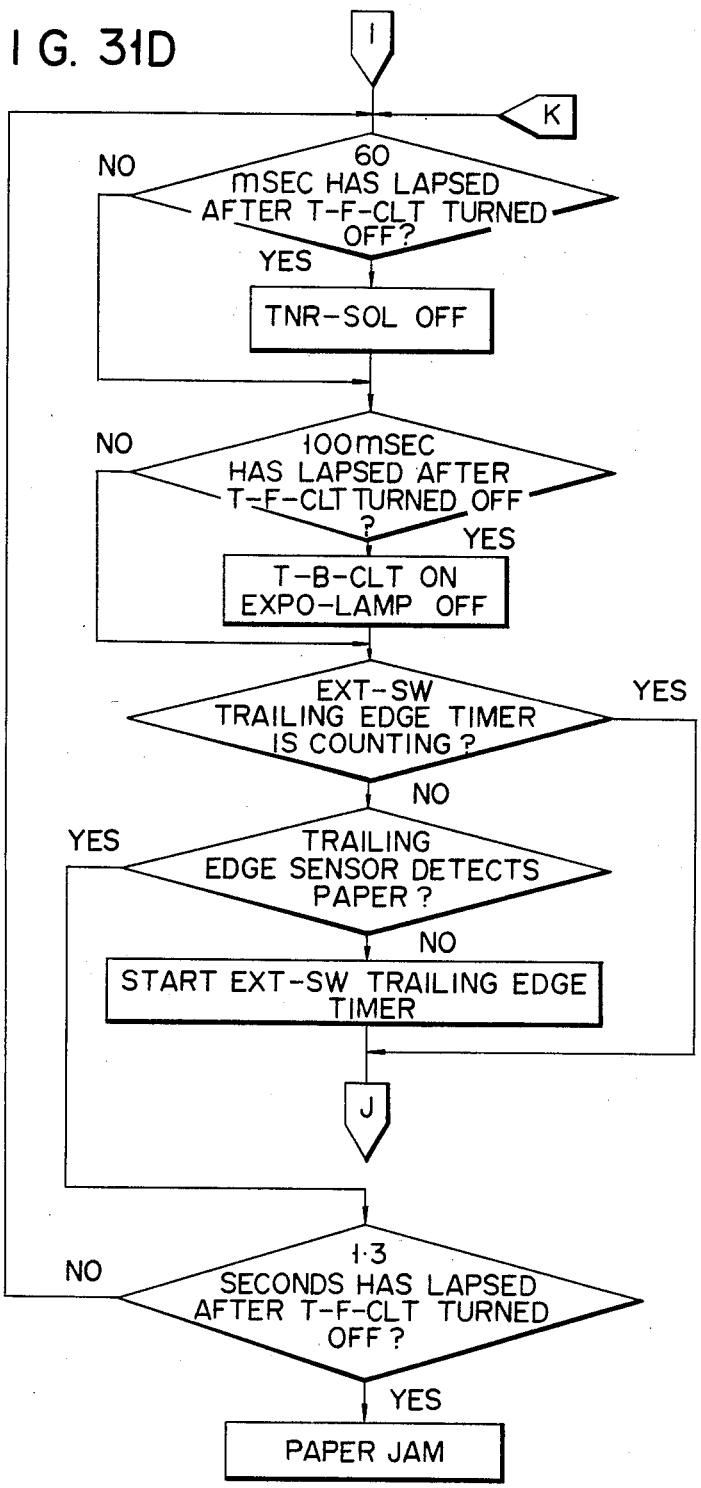
Figure 31E:
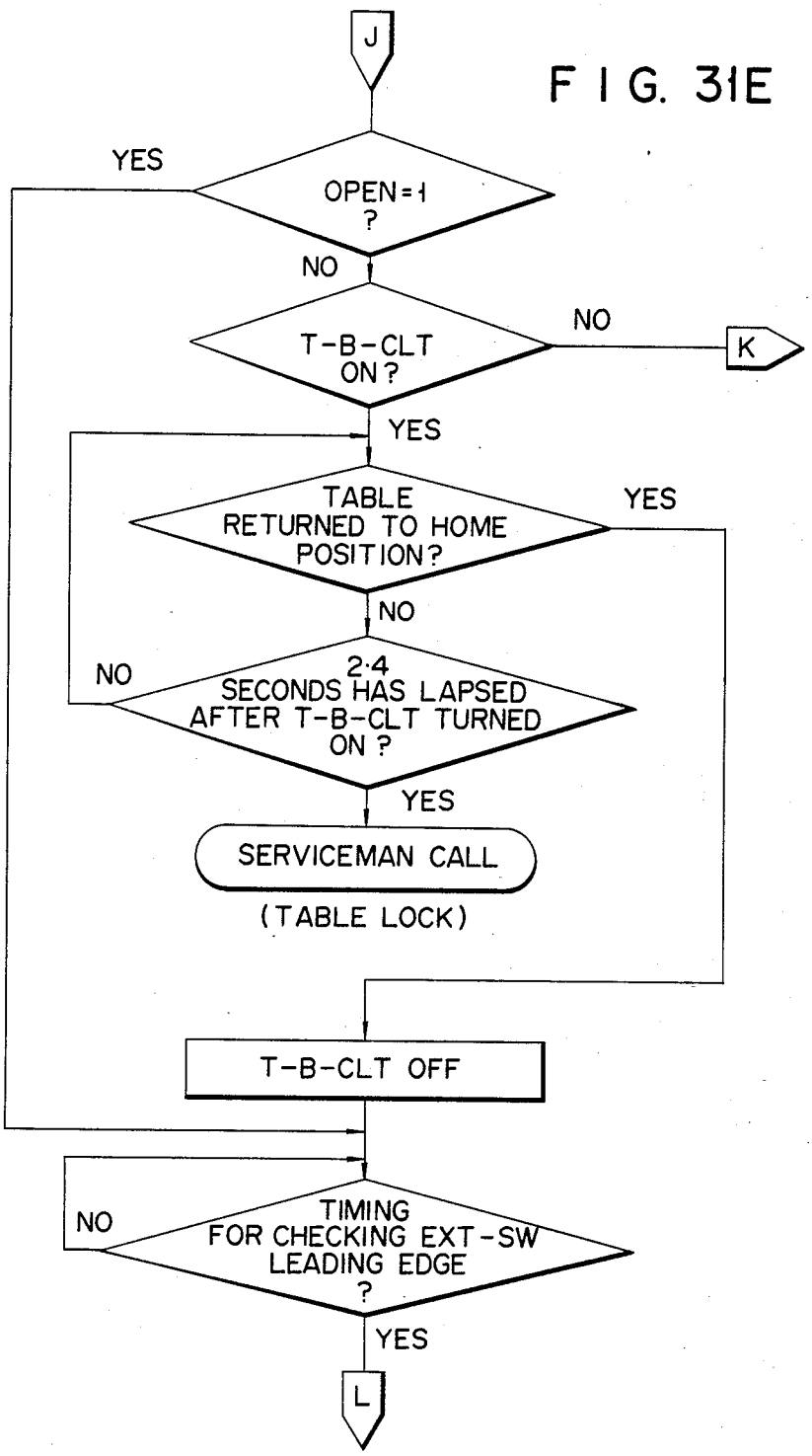
Figure 31F:
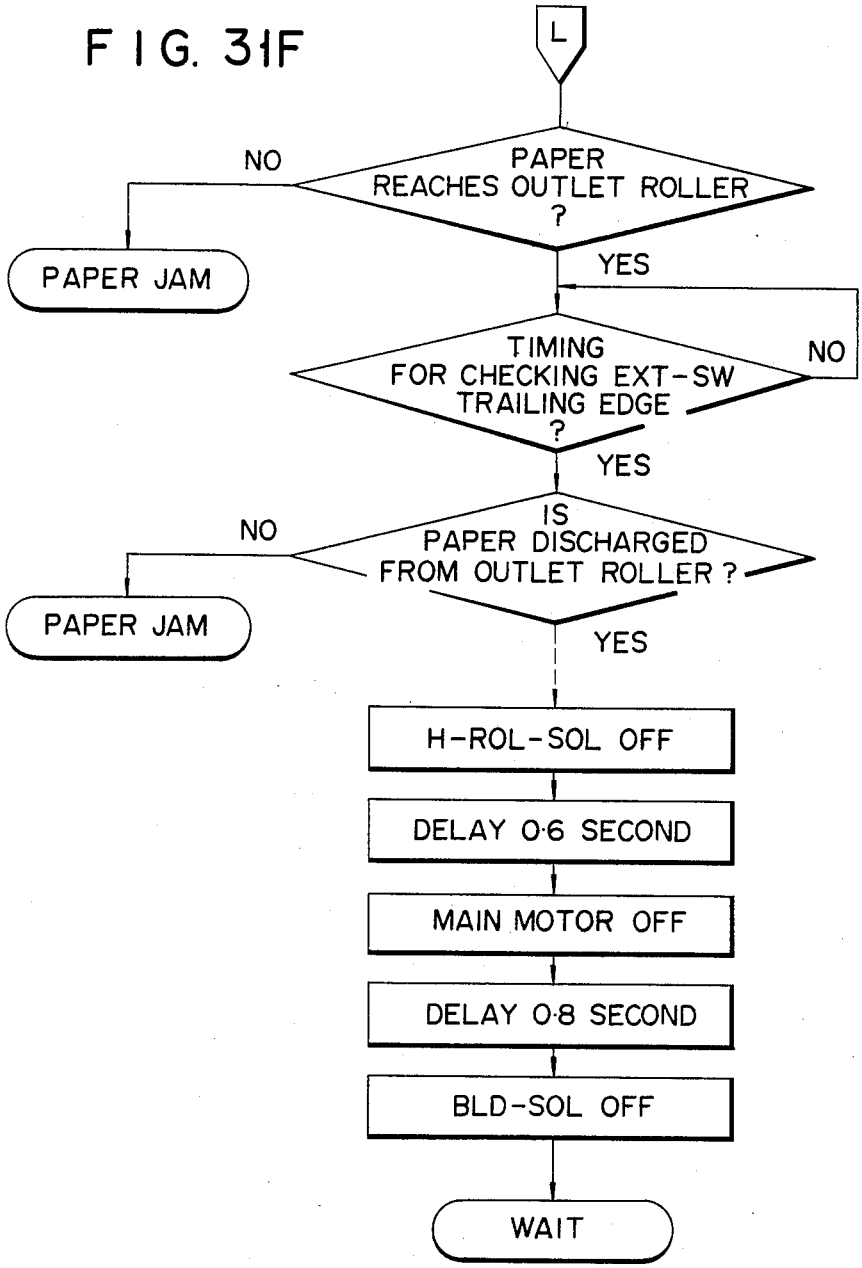
Figure 32A:
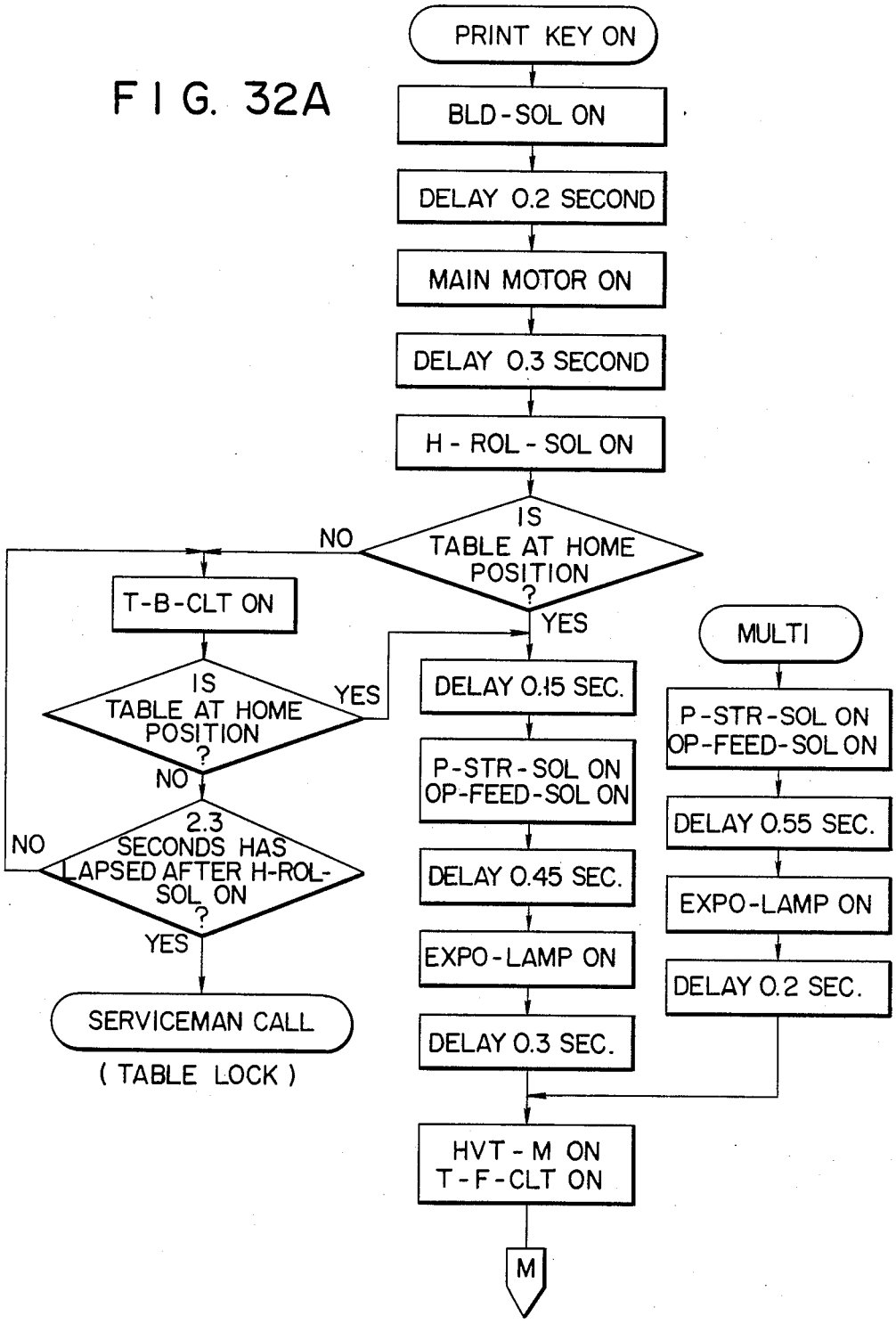
FIGS. 32A to 32F are flow charts for explaining the copying operation using automatic paper feed of the optional cassette.
Figure 32B:
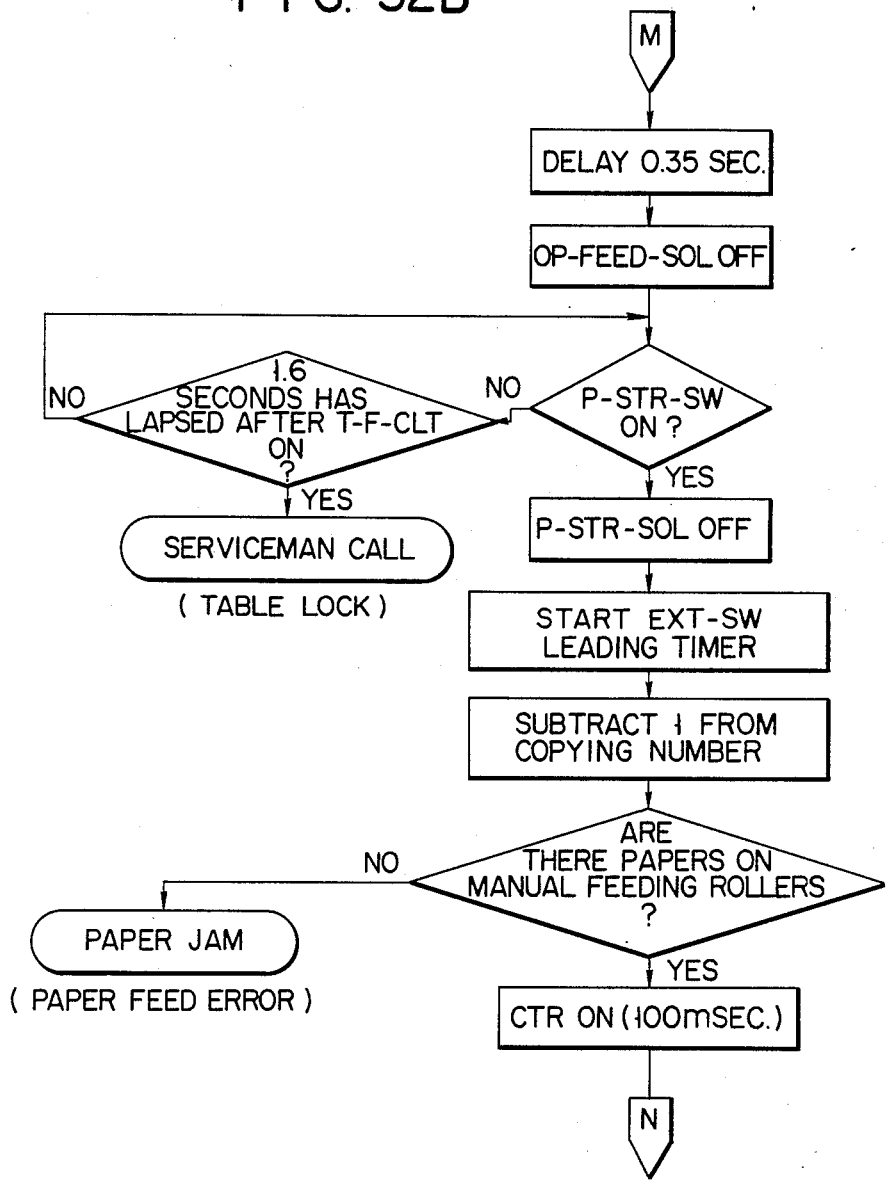
Figure 32C:
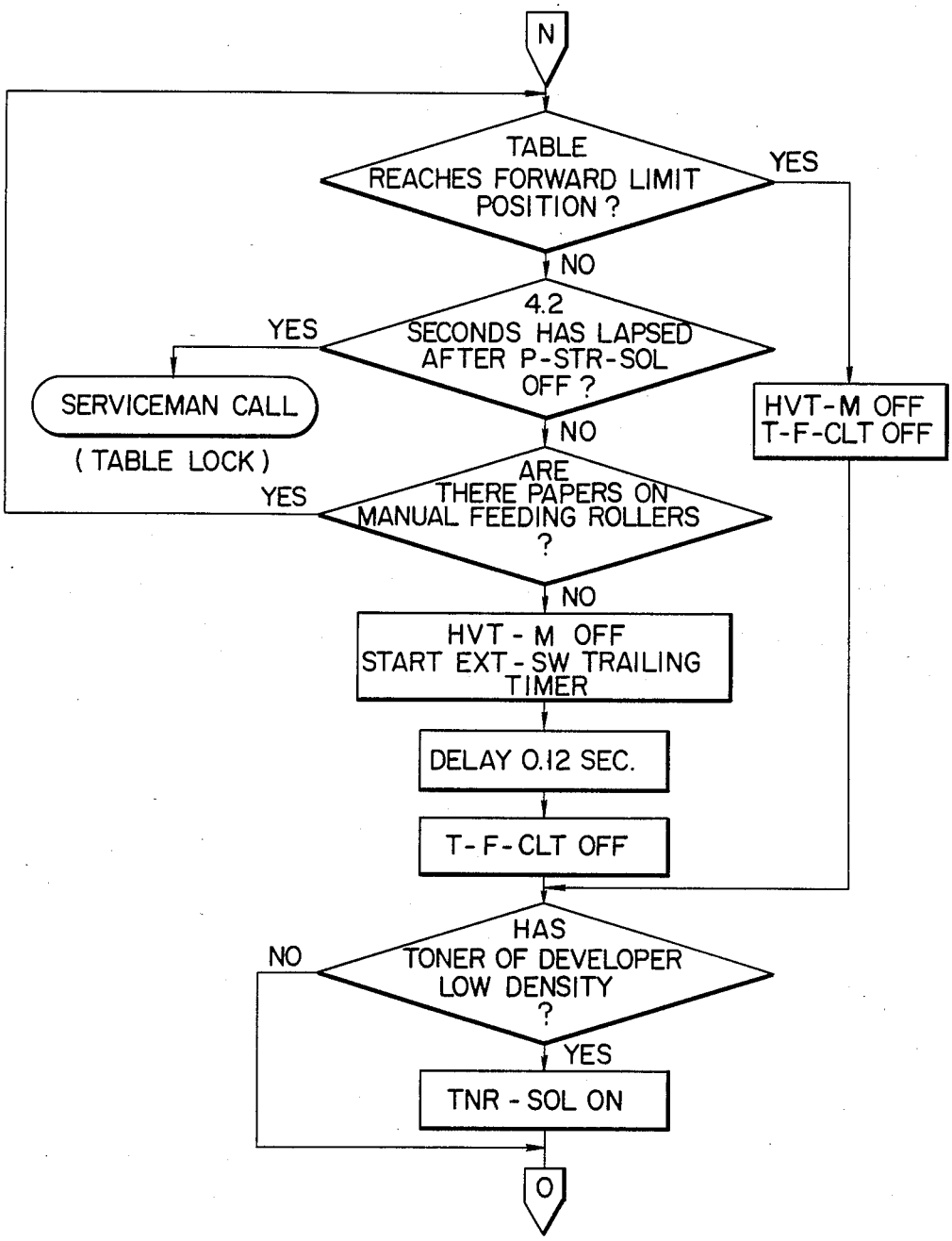
Figure 32D:
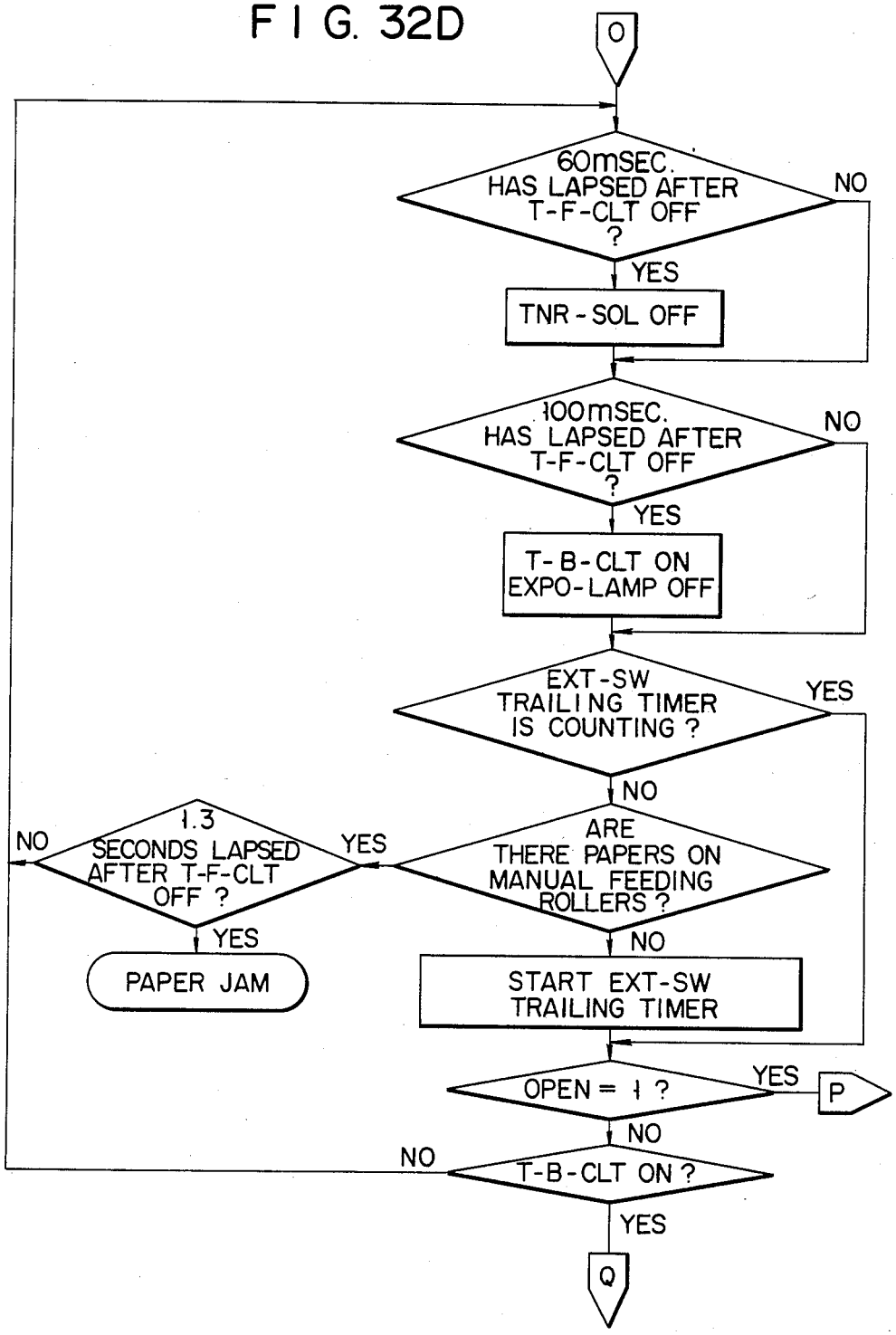
Figure 32E:
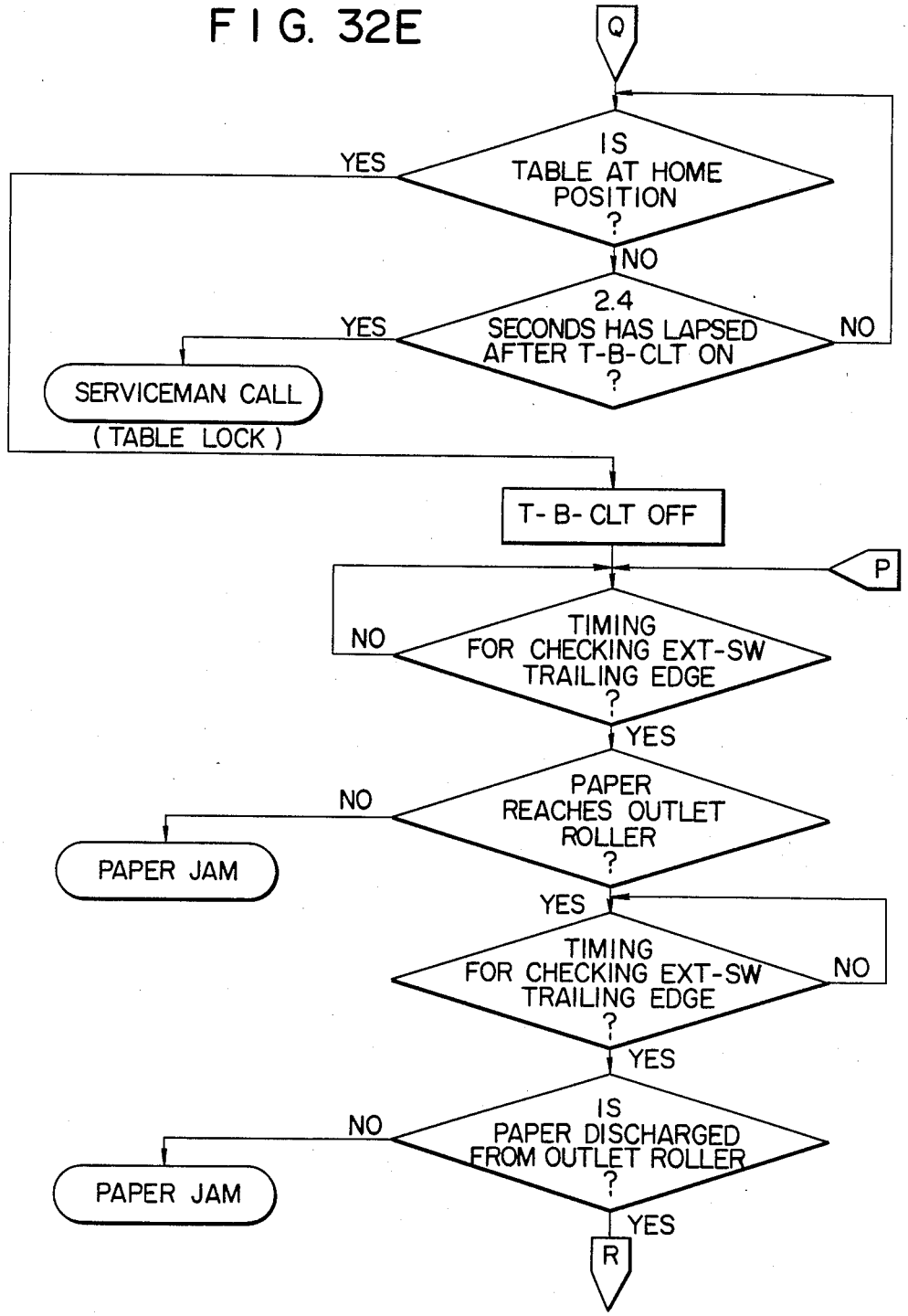
Figure 32F:
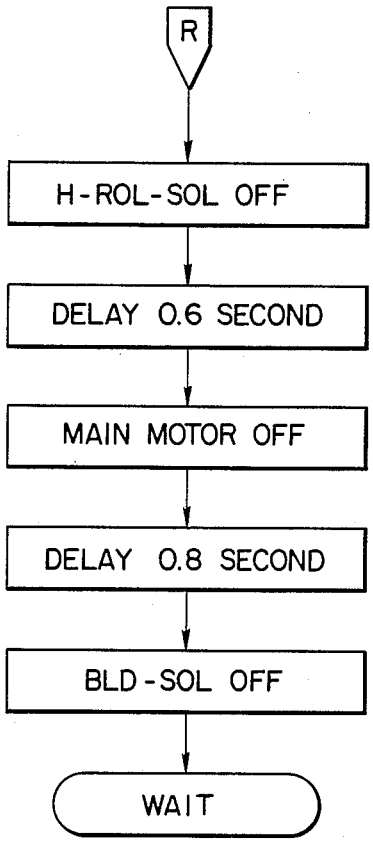
Figure 33A:
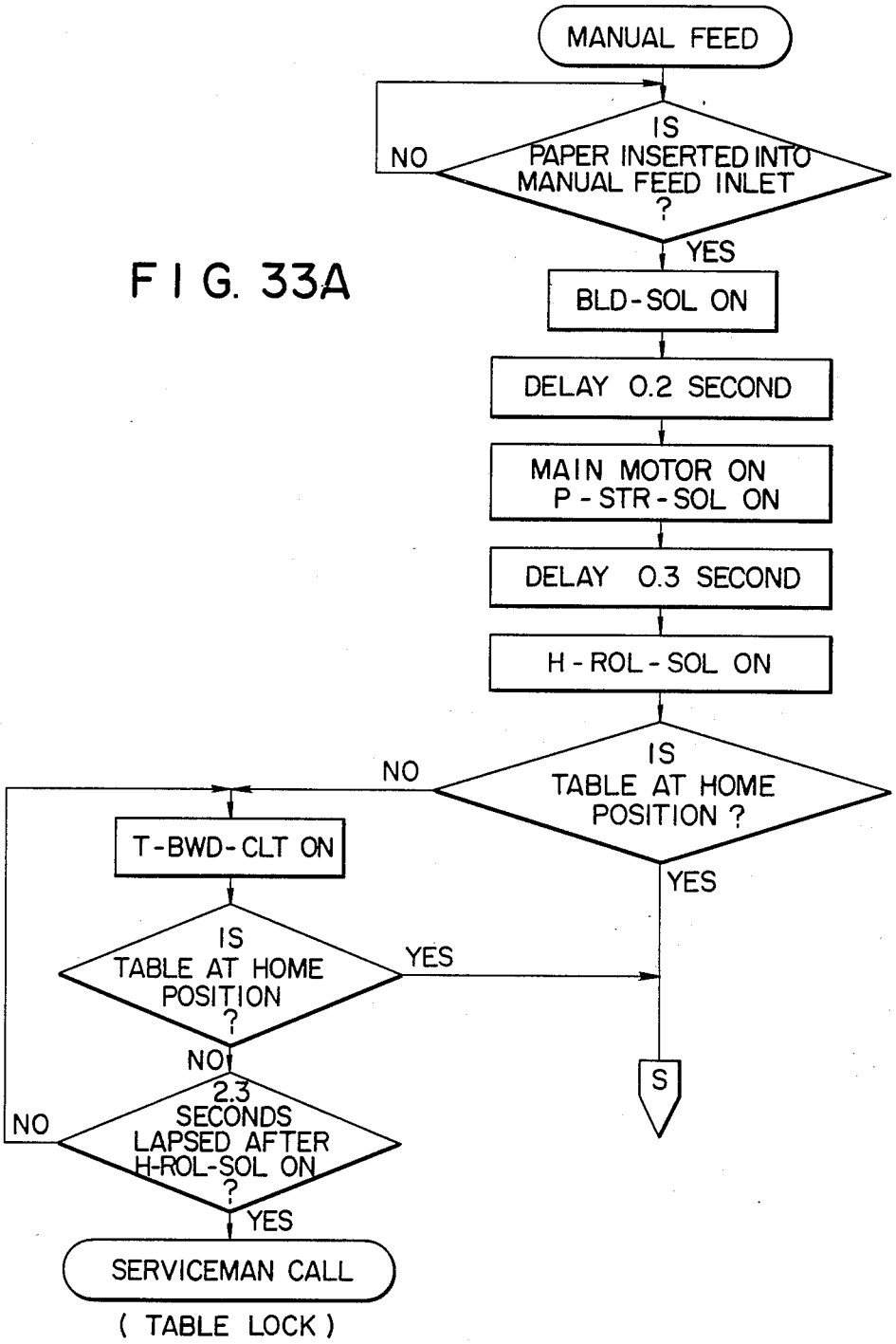
Figure 33B:
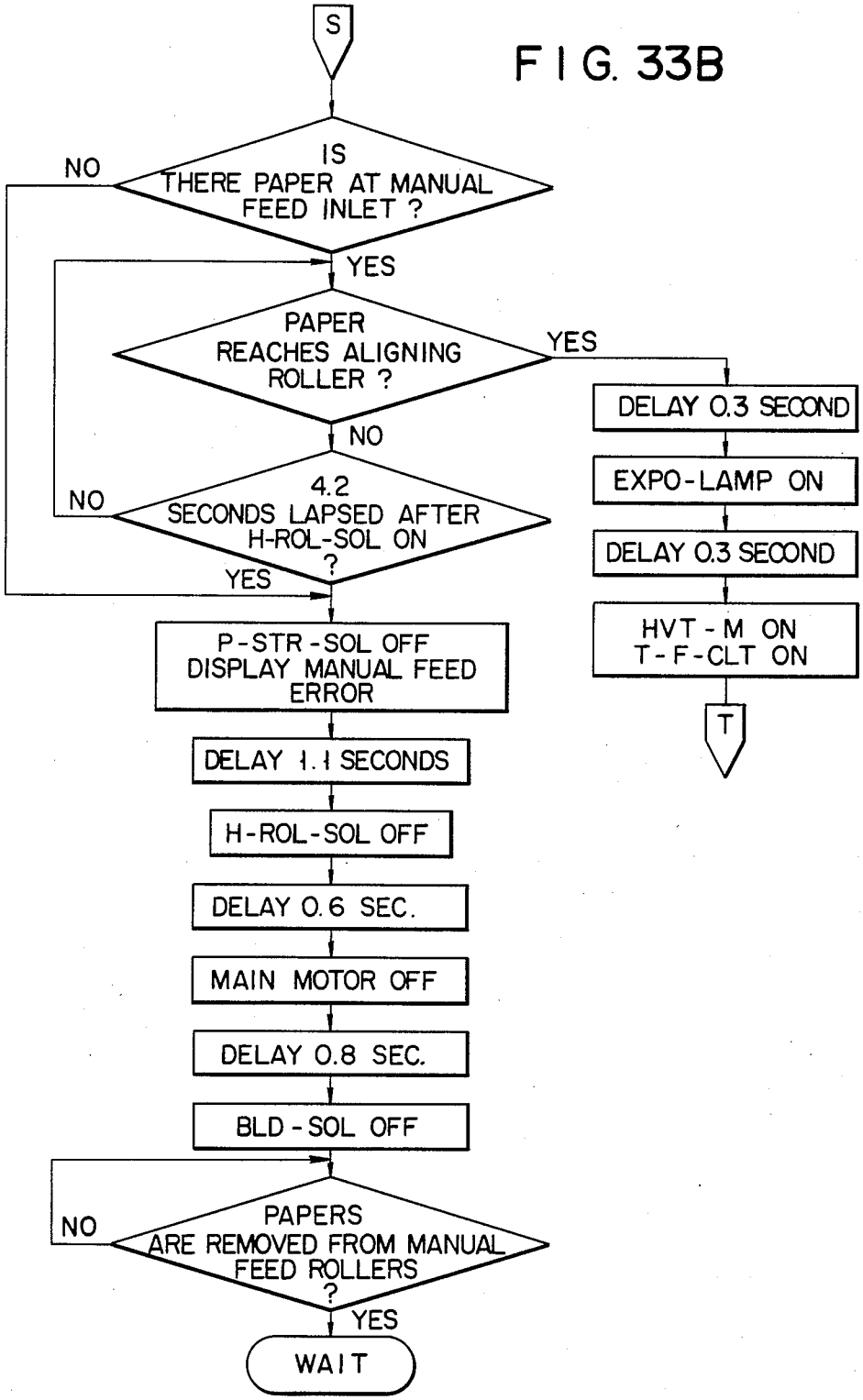
Figure 33C:
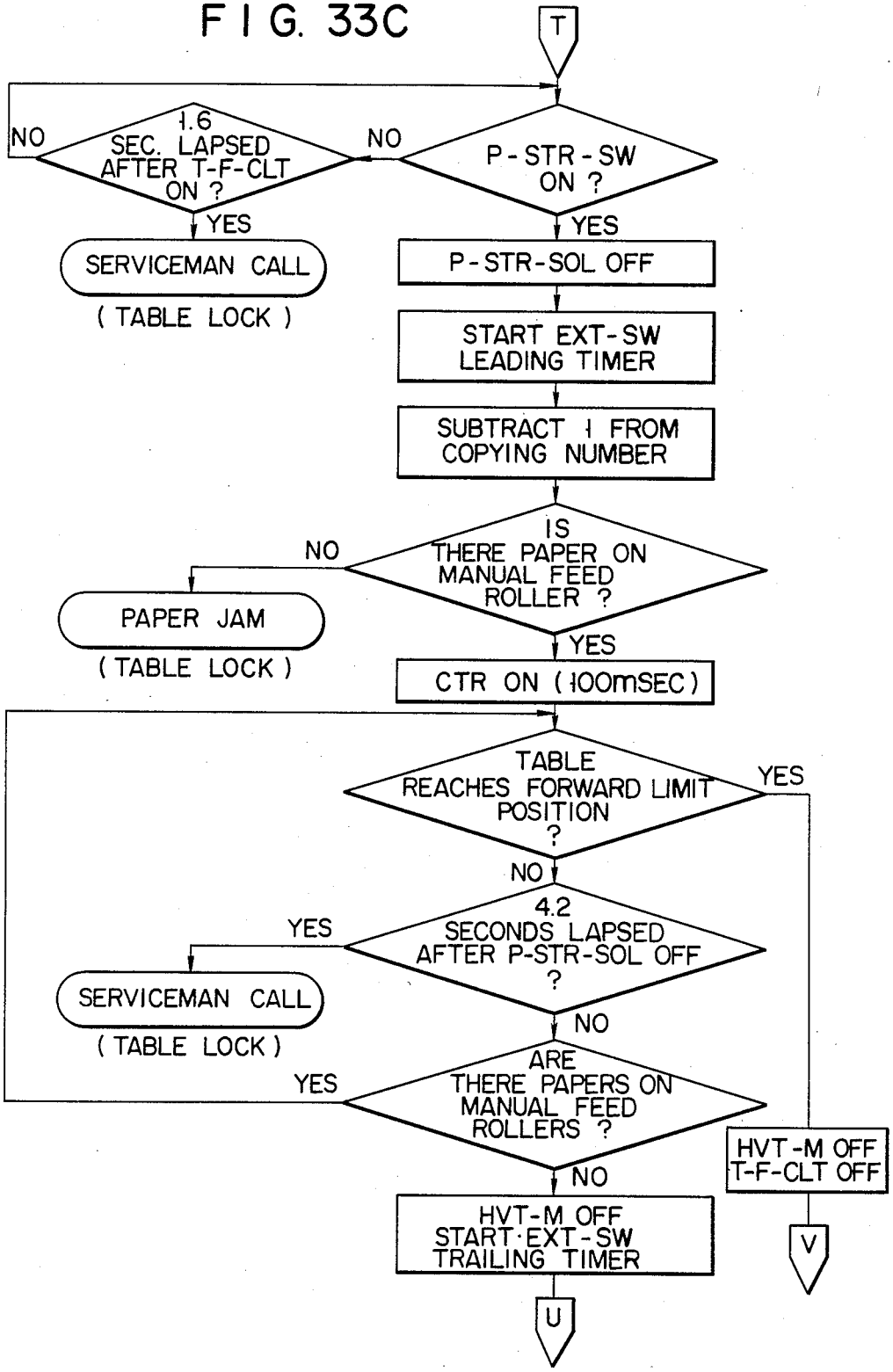
Figure 33D:
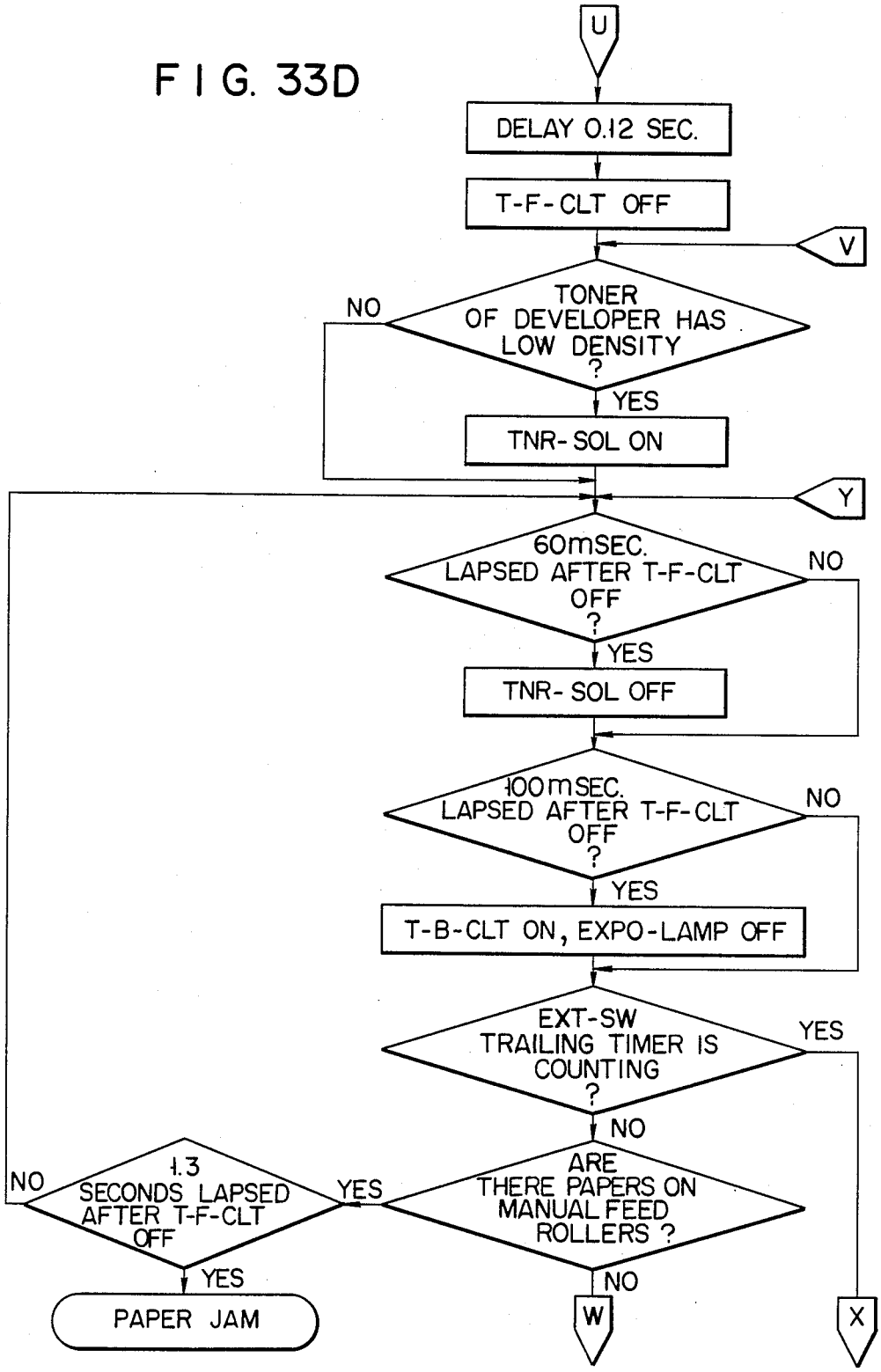
Figure 33E:
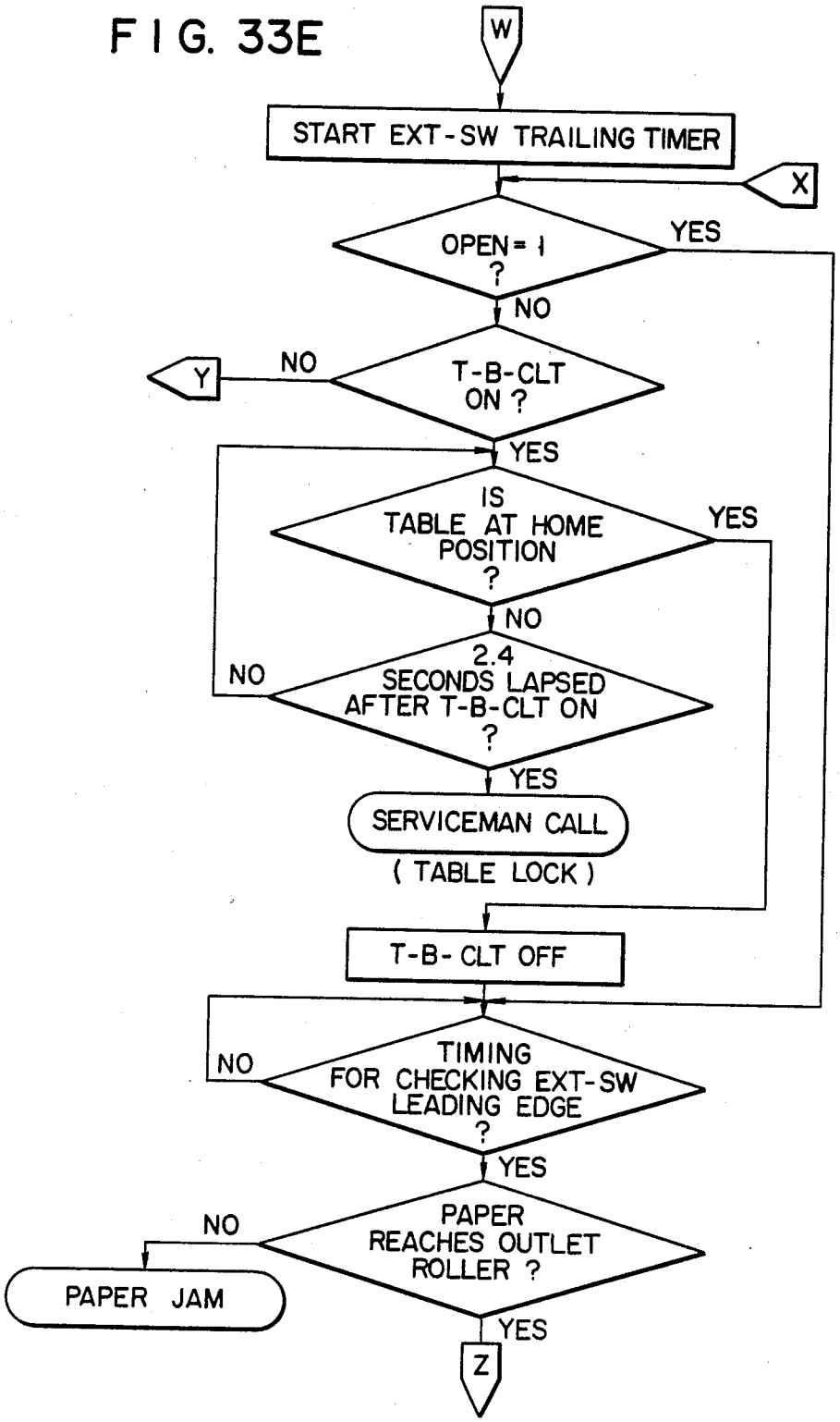
Figure 33F:
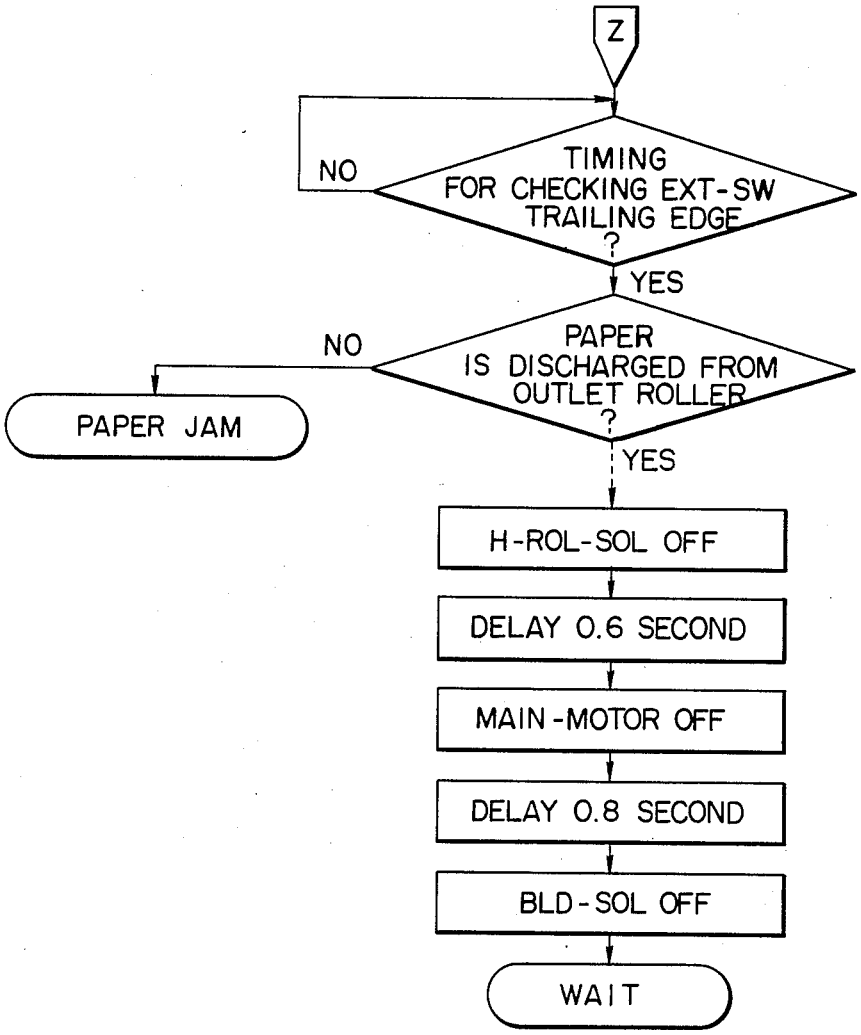

The operation of the peripheral units from the power ON time to the "COPY READY" mode will be described with reference to FIGS. 30A to 30C.

When power is supplied, the exhaust fan 39 is energized to start cooling the inside of the housing 1. At the same time, power is supplied from a DC power source. Subsequently, the heat rollers 35 are heated. It is then checked whether or not the toner bag is filled with the toner in accordance with the status of the switch. If YES, a sign is displayed to indicate to exchange the toner bag. However, if it is determined that the tone bag is not filled with the toner, it is checked whether or not the lens is set in the equal-size position (or initial position). If NO in the above step, the lens is restored to the equal-size position. However, if it is determined that the lens is located in the equal-size position, the BLD-SOL 75 is energized, thereby urging the cleaning blade 73 against the photosensitive drum 2. The discharger 10 then goes on. When a predetermined time has elapsed, the main motor is started. The transfer charger 27, the separating charger 28, and the HVT-M 11 are sequentially energized. Thereafter, the heat roller solenoid H-ROL-SOL is energized. It is then checked whether or not the heat rollers 35 have reached a fixing temperature range. If NO, it is checked whether or not a predetermined time (e.g., 7 seconds) has elapsed after the H-ROL-SOL is energized. If YES, it is checked whether or not any paper sheet is jammed along the paper path. If YES, "PAPER JAM" sign is displayed. In the above step, if it is determined that the heat rollers 35 have reached the fixing temperature range, it is checked whether or not at least 1.1 seconds have elapsed after the H-ROL-SOL is energized. If YES, it is determined whether or not any paper sheet is jammed along the paper path. The same operation is performed in accordance with the result of the immediately above step. When the H-ROL-SOL is de-energized, the pressure of the heat rollers is released. In 0.6 second, the main motor is stopped. Furthermore, in 0.8 second after the main motor is stopped, the blade solenoid BLD-SOL is de-energized. As a result, the pressure is released from the cleaning blade, and the discharger lamp goes off. It is checked again whether or not the heat rollers have reached the fixing temperature range. If YES, the standby mode is initiated.

The copying operation will be described in accordance with the flow charts in FIGS. 31A to 33F.

The following types of copying operation are exemplified: (a) automatic feed by use of the automatic paper cassette 21; (b) automatic feed by use of the optional cassette 23; and (c) manual feed by use of the optional cassette 23.

(a) Automatic Feed by Use of Automatic Paper Cassette 21 (FIGS. 31A to 31F)

When the manual table is provided, cassette selection need not be performed. However, when the optional cassette 23 is mounted, the manual guide must be moved in the direction indicated by arrow M in FIG. 16 so as to perform automatic feed by use of the automatic paper cassette 21. Alternatively, when the optional cassette 23 is not mounted, automatic feed by use of the automatic paper cassette 21 is performed.

When the operator presses the start key (not shown) on the control panel 52, the P-FEED-SOL 128 and the P-STR-SOL 123 are OFF. The aligning rollers 26 are rotated, whereas the manual feed rollers 25 and the feed roller 22 are stopped. The cleaning blade 73 is urged against the photosensitive drum 2, and the discharger 10 is turned on. Thereafter, in 200 ms, urging operation of the cleaning blade 73 is completed. The main motor is started, and the blower is ON (suction is started). Furthermore, the paper detection lamp goes on, and the transfer charger, the separating charger and the HVT-M are ON. When 300 ms have elapsed during which the developing unit is constantly rotated, the H-ROL-SOL is energized, thereby pressing the heat rollers. In the size-reduction mode, the lamp which indicates the erasure of the two ends of the image goes on at the above-mentioned timing. Thereafter, when 300 ms have elapsed during which the document table is restored to the home position if it is not located thereat, the exposure lamp goes on. When 100 ms have elapsed, the P-STR-SOL 123 is then energized.

The P-FEED-SOL 128 is OFF simultaneously when the P-STR-SOL 123 is ON. Also, the aligning rollers 26 are stopped, the manual feed rollers 25 are rotated, and the feed rollers 22 are stopped.

When 100 ms have elapsed after the P-STR-SOL 123 is ON, the P-FEED-SOL 128 is ON for 100 ms. At the same time, the aligning rollers 26 are stopped, the manual feed rollers 25 are rotated, and the feed rollers 22 are rotated by one revolution. Upon one revolution of the feed rollers 22, the paper sheet is fed from the cassette, and the leading edge of the paper sheet abuts against the aligning rollers 26. The charger is ON simultaneously when the P-FEED-SOL 128 is OFF, so that the document table 3 is moved in the forward direction. In the size-reduction mode, when 100 ms have elapsed, the document table starts moving in the forward direction. The document table 3 then waits to turn on the P-STR-SW 145B (alignment). In this stage, an electrostatic latent image is formed on the photosensitive drum 2. Thereafter, the electrostatic latent image is developed by the developing unit.

When the P-STR-SW 145B is ON, the P-STR-SOL 123 and the P-FEED-SOL 128 are OFF. The aligning rollers 26 are rotated, whereas the manual feed rollers 25 and the feed rollers 22 are stopped. Therefore, the paper sheet is conveyed by the aligning rollers 26 to the transfer section. When the P-STR-SOL 123 is de-energized, the counter (CTR) starts its count-up operation. A toner or visible image is transferred onto the paper sheet conveyed in the transfer section. Subsequently, the paper sheet is separated from the photosensitive drum 2 and is conveyed to the fixer by the conveyer rollers. The toner image on the paper sheet is then fixed by the fixer, the trailing edge of the paper sheet is detected by the paper detector, and is delivered to the discharge tray.

When the trailing edge of the paper sheet is detected, the charger 11 is OFF to terminate image scanning. A margin surrounding the image on the document is scanned. When 60 ms have elapsed, the document table stops moving in the forward direction. At this time, when the toner has a low density, an additional toner is replenished. When 100 ms have elapsed, the document table starts moving in the reverse direction, and the exposure lamp 4 goes off. As described with reference to the interrupt subroutine, when the hopper cover 13*a* is opened even once, the document table cannot be moved in the reverse direction and the subsequent copying process is interrupted.

When the document table returns to the predetermined position, it stops. If the operator wishes to make a plurality of copies, the exposure lamp or EXPO-LSMP 4 goes on when the document table returns to the predetermined position. At the same time, the step corresponding to the energization of the P-STR-SOL 123 can be executed. In this case, the timings at which the exposure lamp 4 goes on differ in the first and second copies in the multi-copy mode. The exposure lamp 4 goes on for the second or subsequent copies at a delay of 100 ms as compared with the case of the first copy. The ON time of the exposure lamp 4 for the second and subsequent copies is shorter than that for the first copy according to the following reasons: (1). Since the exposure lamp 4 may be cooled when it goes on for the first copy, its ON time for the first copy must be longer than that for the second and subsequent copies (the exposure lamp 4 is already warmed for the second and subsequent copies); and (2) the ON time of the exposure lamp 4 must be as short as possible to prevent an increase in temperature of the copying machine. It is desirable to determine the ON timing of the exposure lamp 4 after the temperature inside the housing 1 is detected. Furthermore, since it is desirable to shorten the preliminary ON time of the exposure lamp 4 by a time interval during which the exposure lamp is OFF, the above considerations are made in the above embodiment.

When a single copy or the final copy among a plurality of copies is obtained, a "COPY READY" lamp goes on. Furthermore, the outlet switch performs jam detection. The H-ROL-SOL is deenergized, and the lamp for the size-reduction mode goes off. When 600 ms have elapsed, the main motor, the blower, the paper detection lamp, the high-voltage transformer for the transfer and separating chargers and the HVT-M are OFF. When 800 ms have elapsed, the motor is completely stopped, and the pressure of the cleaning blade is released and the discharger lamp goes off.

(b) Automatic Feed by Use of Optional Cassette 23 (FIGS. 32A to 32F)

When the optional cassette 23 is mounted and then the manual guide is moved in the direction indicated by arrow L in FIG. 16, automatic feed by use of the optional cassette 23 can be performed.

When the operator presses the start key (not shown), the P-FEED-SOL 128, the P-STR-SOL 123 and the OP-FEED-SOL 101*c* are all OFF. The aligning rollers 26 are rotated, the manual feed rollers 25 are stopped, the feed rollers 22 are stopped, and the optional feed rollers 93A and 93B are stopped. At this stage, the cleaning blade 73 is urged against the photosensitive drum 2, and the discharger lamp goes on. When 200 ms have elapsed, the main motor, the blower, the paper detection lamp, and the high-voltage transformer are all ON. When 300 ms have elapsed, the H-ROL-SOL is energized. In the size-reduction mode, the lamp for the size-reduction mode goes on when the H-ROL-SOL is energized. At this time, when the document table is not located at the predetermined position, it is restored to the predetermined position. When 150 ms have elapsed, the P-STR-SOL 123 and the OP-FEED-SOL 101*c* are ON. As a result, the paper sheet is fed. Specifically, the aligning rollers 26 are stopped, the manual feed rollers 25 are rotated, the feed rollers 22 are stopped, and the optional feed rollers 93A and 93B are rotated. Thus, the paper sheet is fed by the optional feed rollers 93A and 93B from the cassette and is conveyed by the manual feed rollers 25 to the aligning rollers 93A and 93B. The optional feed rollers 93A and 93B are kept ON for 1.1 seconds. During this time interval, the paper sheet abuts against the aligning rollers 26.

When 450 ms have elapsed after the paper sheet is picked up, the exposure lamp 4 goes on. At this time, the paper feed rollers are not rotated. When 200 ms have elapsed, the charger is energized and the document table is moved in the forward direction. When 350 ms have then elapsed, the OP-FEED-SOL 101*c* is de-energized. The paper sheet remains and waits that the P-STR-SW 145B is turned on.

When the OP-FEED-SOL 101*c* is OFF, the P-STR-SOL 123 and the P-FEED-SOL 128 are OFF. In other words, the aligning rollers 26 are stopped, the manual feed rollers 25 are rotated, the feed rollers 22 are stopped, the optional feed rollers 25 are rotated, the feed rollers 22 are stopped, and the optional feed rollers 93A and 93B are stopped. The leading edge of the paper sheet abuts against the aligning roller 26 and is stopped. At this time, although the manual feed rollers 25 are rotated, the paper sheet is not conveyed in practice since these rollers are slip rollers.

When the P-STR-SW 145B is ON, the P-STR-SOL 123 is OFF. The counter performs the count-up operation. When the P-STR-SOL 123 and the OP-FEED-SOL 101*c* are de-energized, the aligning rollers 26 are rotated, the manual feed rollers 25 are stopped, the feed rollers 22 are stopped, and the optional feed rollers 93A and 93B are stopped. The paper sheet is conveyed by the optional feed rollers 93A and 93B to the transfer section. Thereafter, the trailing edge of the paper sheet is detected by the M-F-SW 138*a*, and the charger is de-energized. When 120 ms have elapsed, the document table stops moving in the forward direction. At this time, when the toner density is low, toner is replenished. When 100 ms have elapsed, the document table starts moving in the reverse direction, and the exposure lamp 4 goes off. The following procedure is the same as the automatic feed by use of the automatic paper cassette 21.

(c) Manual Feed by Use of Optional Cassette 23 (FIGS. 33A to 33F)

If the manual table is provided, special operation is required. When the optional cassette is mounted, the manual guide is moved in the direction indicated by arrow M in FIG. 16.

When the operator inserts a paper sheet in the manual feed slot, the M-F-SW 138*a* is ON. At this time, the cleaning blade 73 is urged against the photosensitive drum 2 and the discharger lamp goes on. When 200 ms have elapsed, the main motor, the blower, the paper detection lamp, the high-voltage transformer, and the P-STR-SOL 123 are respectively ON. When the P-STR-SOL 123 is ON, the aligning rollers 26 are stopped, the manual feed rollers 25 are rotated, and the feed rollers 22 are stopped. The paper sheet is conveyed by the manual feed rollers 25 to the aligning rollers 26. When 300 ms have elapsed after the P-STR-SOL 123 is ON, the H-ROL-SOL is ON. In the size-reduction mode, the lamp for size-reduction mode goes on. In this condition, the paper sheet waits until M-STR-SW 138*b* is ON. When the document table is not located in the predetermined position, it is restored to the predetermined position. When the M-STR-SW 138*b* is not turned on even if about 4 seconds have elapsed, the entire operation is interrupted. The display unit has an instruction which indicates to remove the paper sheet until the M-F-SW 138*a* is turned off. When the M-F-SW 138*a* is OFF, normal conditions are restored. The exposure lamp is turned on in 300 ms after the M-STR-SW 138*b* is turned on. When 300 ms have further elapsed, the charger turns ON and the document table starts to move in the forward direction. Thereafter, when the P-STR-SW 145B is ON, the P-STR-SOL 123 is OFF. When the P-STR-SOL 123 is OFF, the aligning rollers 26 start rotating, whereas other rollers are stopped. Upon rotation of the aligning rollers 26, the paper sheet is conveyed in the transfer section. The subsequent process is the same as the routine described above to perform copying.

What is claimed is:

1. An image forming apparatus, comprising:

image forming means for forming a visible image on a paper sheet;

conveyor means for conveying the paper sheet to said image forming means;

fixing means for fixing the visible image formed on the paper sheet by said image forming means; and control means for controlling said fixing means and said conveyor means, said control means including means for driving said conveyor means for a predetermined time, means for driving said fixing means until the temperature of said fixing means reaches a predetermined temperature, and means for detecting that the temperature of said fixing means reaches said predetermined temperature and stopping said conveyor means when the temperature of said fixing means is detected to be said predetermined temperature.

2. An apparatus according to claim 1, wherein said controlling means comprises a programmable microprocessor connected to said fixing means and said conveyor means, said programmable microprocessor including a central processing unit for receiving timing signals to control said conveyor means, and a read-only memory device which stores a permanent program for functions of said central processing unit so as to perform a specific function of said controlling means, wherein said controlling means controls said fixing means and said conveyor means to perform preheating of said fixing means and driving of said conveyor means for a predetermined time interval immediately after power is supplied and to stop said conveyor means when preheating of said fixing means is completed before the predetermined time interval has elapsed.

3. An apparatus according to claim 1, wherein said control means continues the operation of said conveyor means when a paper sheet is jammed in said paper conveyor means, even if preheating of said fixing means is completed before the predetermined time has elapsed.

4. An apparatus according to claim 1, wherein said image forming means comprises:

a photosensitive drum;

an optical system for radiating light onto a document and guiding light reflected by the document to said photosensitive drum;

discharger means for discharging a surface of said photosensitive drum;

charging means for charging the surface of said photosensitive drum after said photosensitive drum is discharged;

exposure means for exposing the surface of said photosensitive drum after said photosensitive drum is discharged;

developing means for visualizing an electrostatic latent image formed by said exposure means on the surface of said photosensitive drum;

transferring means for transferring a visual image formed on the surface of said photosensitive drum onto a paper sheet;

separating means for separating the paper sheet, onto which the visual image has been transferred, from said photosensitive drum; and cleaning means for cleaning said photosensitive drum.

5. An apparatus according to claim 2, wherein said image forming means comprises:

a photosensitive drum;

an optical system for radiating light onto a document and guiding light reflected by the document to said photosensitive drum;

discharger means for discharging a surface of said photosensitive drum;

charging means for charging the surface of said photosensitive drum after said photosensitive drum is discharged;

exposure means for exposing the surface of said photosensitive drum after said photosensitive drum is discharged;

developing means for visualizing an electrostatic latent image formed by said exposure means on the surface of said photosensitive drum;

transferring means for transferring a visual image formed on the surface of said photosensitive drum onto a paper sheet;

separating means for separating the paper sheet, onto which the visual image has been transferred, from said photosensitive drum; and cleaning means for cleaning said photosensitive drum.

6. An apparatus according to claim 3, wherein said image forming means comprises:

a photosensitive drum;

an optical system for radiating light onto a document and guiding light reflected by the document to said photosensitive drum;

discharger means for discharging a surface of said photosensitive drum;

charging means for charging the surface of said photosensitive drum after said photosensitive drum is discharged;

exposure means for exposing the surface of said photosensitive drum after said photosensitive drum is discharged;

developing means for visualizing an electrostatic latent image formed by said exposure means on the surface of said photosensitive drum;

transferring means for transferring a visual image formed on the surface of said photosensitive drum onto a paper sheet;

separating means for separating the paper sheet, onto which the visual image has been transferred, from said photosensitive drum; and cleaning means for cleaning said photosensitive drum.

* * * * *

UNITED STATES PATENT AND TRADEMARK OFFICE

CERTIFICATE OF CORRECTION

PATENT NO. : 4,540,274

DATED : September 10, 1985

INVENTOR(S) : ABUYAMA, Y.

It is certified that error appears in the above-identified patent and that said Letters Patent is hereby corrected as shown below:

Title page:

The assignee should be shown as: TOKYO SHIBAURA DENKI KABUSHIKI KAISHA. Under "Related U.S. Application Data" it should be: Continuation of Ser. No. 457,279, Jan. 11, 1983, abandoned.

Signed and Sealed this

*Eighteenth* Day of *March 1986*

[SEAL]

*Attest:*

DONALD J. QUIGG

*Attesting Officer*

*Commissioner of Patents and Trademarks*